US011473777B2

(12) United States Patent
Doucet et al.

(10) Patent No.: US 11,473,777 B2
(45) Date of Patent: Oct. 18, 2022

(54) METHODS OF PRODUCING A GAS FROM A COMBUSTIBLE MATERIAL

(71) Applicant: Wildfire Energy Pty Ltd, Queensland (AU)

(72) Inventors: Denis Alexander Doucet, Queensland (AU); Grant James Bollaert, Queensland (AU); Gregory Martin Parry Perkins, Queensland (AU)

(73) Assignee: Wildfire Energy Pty Ltd, Queensland (AU)

( * ) Notice: Subject to any disclaimer, the term of this patent is extended or adjusted under 35 U.S.C. 154(b) by 989 days.

(21) Appl. No.: 16/306,425

(22) PCT Filed: Jun. 5, 2017

(86) PCT No.: PCT/AU2017/050549
§ 371 (c)(1),
(2) Date: Sep. 4, 2020

(87) PCT Pub. No.: WO2017/205943
PCT Pub. Date: Dec. 7, 2017

(65) Prior Publication Data

US 2020/0326067 A1 Oct. 15, 2020

(30) Foreign Application Priority Data

Jun. 3, 2016 (AU) ..... 2016902161

(51) Int. Cl.
*F23G 7/10* (2006.01)
*C10J 3/04* (2006.01)
(Continued)

(52) U.S. Cl.
CPC ..... *F23G 7/10* (2013.01); *C10J 3/04* (2013.01); *C10J 3/24* (2013.01); *C10J 3/723* (2013.01);
(Continued)

(58) Field of Classification Search
CPC ..... C10J 2200/152; C10J 2300/0956; C10J 2300/0959; C10J 3/482; C10J 3/723; C10J 3/463; F23G 5/34
See application file for complete search history.

(56) References Cited

U.S. PATENT DOCUMENTS 1,729,572 A 9/1929 Evans
3,561,377 A 2/1971 Amundsen
(Continued)

FOREIGN PATENT DOCUMENTS

CN 203173215 U 9/2013
DE 2317441 A1 10/1974
(Continued)

OTHER PUBLICATIONS

Arena "Process and Technological Aspects of Municipal Solid Waste Gasification, A Review" Waste Management vol. 32, pp. 625-639, 2012.
(Continued)

*Primary Examiner* — Imran Akram
(74) *Attorney, Agent, or Firm* — EcoTech Law Group, P.C.

(57) ABSTRACT

Disclosed are methods and systems for producing a gas from a combustible material. In particular, disclosed are methods and systems for batch-type production of a gas from a combustible material. The methods and systems include igniting at least a portion of the combustible material loaded in the sealed containment structure to form a thermally affected layer, wherein the step of feeding the oxidant into the sealed containment structure is carried out so that conversion of the combustible material to a gas at one point in the sequence is initiated prior to complete conversion of the combustible material at a previous point in the sequence.

8 Claims, 16 Drawing Sheets

(51) Int. Cl.

| | |
|---|---|
| ***C10J 3/24*** | (2006.01) |
| ***C10J 3/72*** | (2006.01) |
| ***F23G 5/027*** | (2006.01) |
| ***F23G 5/34*** | (2006.01) |

(52) U.S. Cl.
CPC ..... *F23G 5/0276* (2013.01); *F23G 5/34* (2013.01); *C10J 2200/09* (2013.01); *C10J 2200/152* (2013.01); *C10J 2300/0916* (2013.01); *C10J 2300/0946* (2013.01); *C10J 2300/0956* (2013.01); *C10J 2300/0959* (2013.01); *F23G 2201/10* (2013.01); *F23G 2201/301* (2013.01); *F23G 2201/40* (2013.01)

(56) References Cited

U.S. PATENT DOCUMENTS

| | | | | |
|---|---|---|---|---|
| 3,869,994 | A | 3/1975 | Von Berlichingen | |
| 3,870,652 | A * | 3/1975 | Whitten | C10B 49/04 201/38 |
| 4,268,274 | A * | 5/1981 | Caughey | C10B 53/02 202/117 |
| 4,308,034 | A * | 12/1981 | Hoang | C10J 3/36 202/117 |
| 6,485,296 | B1 * | 11/2002 | Bender | C10J 3/36 110/212 |
| 6,709,636 | B1 * | 3/2004 | Oshita | C10J 3/482 422/139 |
| 8,137,655 | B2 | 3/2012 | Enerkem | |
| 8,668,753 | B2 | 3/2014 | Goetsch et al. | |
| 10,208,578 | B2 | 2/2019 | Perkins | |
| 2006/0000143 | A1 * | 1/2006 | Nagato | F17C 11/007 48/198.2 |
| 2007/0014704 | A1 * | 1/2007 | Hashimoto | F27B 14/10 422/139 |
| 2009/0265987 | A1 * | 10/2009 | Xu | C10J 3/66 48/89 |
| 2010/0107494 | A1 * | 5/2010 | Raynaud | C10J 3/22 48/197 R |
| 2010/0115841 | A1 | 5/2010 | Cork | |
| 2010/0269411 | A1 | 10/2010 | Goetsch et al. | |
| 2011/0107945 | A1 * | 5/2011 | Suda | C10J 3/463 110/341 |
| 2013/0192139 | A1 | 8/2013 | Stevenson et al. | |
| 2014/0328730 | A1 * | 11/2014 | Takafuji | C10B 49/10 422/187 |
| 2015/0232771 | A1 * | 8/2015 | Bell | C10K 1/02 422/618 |
| 2015/0247636 | A1 | 9/2015 | Einarsson | |

FOREIGN PATENT DOCUMENTS

| | | | |
|---|---|---|---|
| GB | 1420827 | A | 1/1976 |
| WO | WO-2013/032352 | A1 | 3/2013 |
| WO | WO-2014/043747 | A1 | 3/2014 |
| WO | WO-2014/085855 | A1 | 6/2014 |

OTHER PUBLICATIONS

Breeze "Advanced Waste-to-Energy Technologies: Gasification, Pyrolysis, and Plasma Gasification" Energy From Waste, pp. 65-75, 2018.

Seo et al "Gasification of Municipal Solid Waste" Gasification for Low-Grade Feedstock, pp. 115-141, 2018.

* cited by examiner

METHODS OF PRODUCING A GAS FROM A COMBUSTIBLE MATERIAL

CROSS-REFERENCE TO RELATED APPLICATIONS

This application is the National Stage of International Application No. PCT/AU2017/050549, filed Jun. 5, 2017, which claims the benefit of Australian Application No. 2016902161, filed Jun. 3, 2016. The contents of both applications are hereby incorporated by reference in their entirety.

TECHNICAL FIELD

The present disclosure relates to a method for carrying out biomass gasification. In particular, a system and method for gasification of biomass using a batch process is disclosed.

CROSS-REFERENCE TO RELATED APPLICATION

This application claims the benefit of Australian Provisional Application Number 2016902161, filed 3 Jun. 2016, the subject matter of which is incorporated herein by reference in its entirety.

SUMMARY

The following is a broad summary of various exemplary embodiments of a method for carrying out gasification of a combustible material. As such, it is provided solely for the purpose of enhancing the clarity of the specification. It is not intended to limit the scope of the appended claims.

It will be appreciated that reference herein to "preferred" or "preferably" is intended as exemplary only.

In one aspect, there is provided a method of producing a gas from a combustible material, the method comprising the steps of:

(a) loading the combustible material into a containment structure;

(b) substantially sealing the containment structure;

(c) feeding an oxidant into the sealed containment structure to contact the combustible material at multiple points in a sequence; and (d) igniting at least a portion of the combustible material loaded in the sealed containment structure to form a thermally affected layer, wherein the step of feeding the oxidant into the sealed containment structure is carried out so that conversion of the combustible material to a gas at one point in the sequence is initiated prior to complete conversion of the combustible material at a previous point in the sequence.

In some embodiments, after step (d), the thermally affected layer may be removed from the containment structure. After removal of the thermally affected layer, steps (a) to (d) may be repeated.

In alternative embodiments, after step (d) the thermally affected layer may remain in the containment structure and further combustible material may be added to the thermally affected layer.

The oxidant may be fed into the sealed containment structure by an injection member configured to include a plurality of oxidant outlets arranged to carry a flow of an oxidant.

The injection member may be positioned along at least a portion of a base of the containment structure.

The injection member may be configured to be movable in the containment structure such that an oxidant outlet at the previous point in the sequence is moved to the one point in the sequence for initiation of gas conversion, and is replaced at the previous point by a further oxidant outlet that at least partially continues conversion of the combustible material at the previous point. The distance moved may be substantially equal to a spacing between adjacent oxidant outlets.

The injection member may be a duct configured to be retractable along a length of the containment structure. The plurality of oxidant outlets may be fixed positions on the duct.

The plurality of oxidant outlets may be arranged on an injection member configured to be fixed in the containment structure, and wherein the, or each, oxidant outlet includes a valve to operably regulate the flow of the oxidant from the, or each, oxidant outlet such that during operation, an oxidant outlet at the previous point in the sequence is substantially closed and a further oxidant outlet at the one point in the sequence for initiation of gas conversion is substantially opened.

The fixed injection member may include an oxidant outlet interposing the previous point and the one point is kept substantially opened to thereby maintain conversion at that point.

The, or each, oxidant outlets may be of generally equal size.

The oxidant may be fed into the combustible material along an axis of the containment structure.

In one embodiment, the method further includes repeating steps (a) to (d).

In one embodiment, the method of producing a gas from a combustible material comprises the steps of:

(a) loading the combustible material into a containment structure;

(b) substantially sealing the containment structure;

(c) feeding an oxidant into the sealed containment structure to contact the combustible material at multiple points in a sequence; and (d) igniting at least a portion of the combustible material loaded in the sealed containment structure to form a thermally affected layer, wherein the step of feeding the oxidant into the sealed containment structure is carried out so that conversion of the combustible material to a gas at one point in the sequence is initiated prior to complete conversion of the combustible material at a previous point in the sequence.

(e) adding further combustible material to the thermally affected layer; and (f) (optionally) repeating steps (b) to (e).

The method of producing a gas from a combustible material may further include a step of drying the combustible material loaded in the sealed containment structure by injecting a drying medium into the sealed container structure.

Drying the combustible material may be performed prior to step (c). Drying the combustible material may be performed by feeding a drying medium into the containment structure.

The method of producing a gas from a combustible material may further include supplying a solution comprising liquid tar and water into the containment structure during gasification to thereby gasify the tar and convert the water to steam.

In another aspect, there is provided a system to produce a gas from a combustible material, the system comprising a containment structure configured to receive the combustible material, the containment structure being arranged to be substantially sealed in operation; and a feeding mechanism to feed an oxidant into a sealed containment structure to contact the combustible material at multiple points in a sequence.

Suitably, the feeding mechanism may be configured such that feeding the oxidant into the sealed containment structure is carried out so that conversion of the combustible material to a gas at one point in the sequence is initiated prior to complete conversion of the combustible material at a previous point in the sequence.

According to any aspect mentioned herein, the combustible material may comprise a biomass material. The combustible material may substantially comprise a biomass material.

The thermally affected layer may comprise a biomass material. The thermally affected layer may be, or comprise, a thermally affected biomass layer.

The biomass material may be derived from a renewable energy source. The renewable energy source may be a plant-derived material or an animal-derived material. The renewable energy source may be a combination of plant-derived material and an animal-derived material.

The present disclosure may include a method whereby biomass is loaded into a large man-made rectangular pit which is dug into the earth and is furnished with an injection pipe along the bottom of the pit and a production pipe at the end of the pit. After the pit is filled with biomass the top of the pit is sealed off. The biomass near the end of the injection pipe may be ignited and air or oxygen is supplied through the injection pipe to consume the biomass by gasification at near atmospheric pressure. Hot product gas may be produced from the production pipe for use in downstream applications such as electricity generation, synthetic fuels production or chemicals production. In order to provide constant syngas quality the injection point can be gradually retracted throughout the burn until substantially all of the biomass is consumed. Once the biomass is consumed the pit may be purged and cooled and the covers may be opened to allow re-instatement of the injection pipe and refilling with biomass. The process may be conducted in batches and may require at least two pits to maintain continuous gas production, wherein one pit is in service while the other pit is being filled and prepared. Uncombusted biomass may be left in the pit after gasification can be left in place to be consumed in the next burn. Ash left behind after consumption of the biomass may be retained in the pit and may build up after each burn requiring periodic removal.

The present disclosure includes a design for the gasification pit and associated equipment. The present disclosure may relate to a gasification pit, particularly in the form of a non-natural, synthetic or man-made gasification pit. The pit may be constructed by excavating a long rectangular channel with sloping sides to provide stability and avoid costly retaining methods. The sides and base of the pit may be bare earth or may be lined with materials such as clay, geomembranes, concrete or steel to prevent migration of liquids or gases from the pit. The top of the pit may be at least partially open during the filling stage and may be substantially sealed from the atmosphere during the gasification stage. Movable cover plates of hinged, sliding or loose design and made of non-combustible materials such as steel, concrete or refractory may be used to seal the top of the pit. A relatively gas-tight seal may be required to prevent air ingress or gas leakage from the pit during gasification. A concrete foundation around the edges of the pit may be used to create an effective seal between the cover plates and the earth. The cover plates may be exposed to high temperature and may require appropriate materials such as high temperature rated cement or refractory.

The injection pipe may be used to convey the oxidant which may be air or oxygen or a mixture thereof. Water or steam may also be injected along with the oxidant as gasification reagents or for cooling purposes. The injection pipe may preferably be made of carbon or alloy steel. Suitable designs for the injection pipe may include jointed pipe (using flanges, threaded couplings or clamps), coiled tubing or pipe which contains a series of holes/nozzles along its length to create multiple simultaneous injection points. Methods for retracting the injection point may include shortening the injection pipe by pulling out and removing jointed sections, severing the pipe or joints using thermal or mechanical means, or by reeling in a coiled tubing. A nozzle may be fitted to the end of the injection pipe to increase the velocity of oxidant exiting the pipe and promote more efficient mixing and gasification. Multiple injection pipes may be used to improve distribution of the oxidant depending on the width of the pit.

The production pipe may be vertical or inclined and shall be designed to handle high temperature product gas from the gasifier. If required the product gas may be cooled by injection of water directly into the gas or by circulating cooling water through the production pipe.

In an embodiment, the injection pipe is located inside a perforated liner pipe in order to prevent collapse of biomass onto the pipe and to maintain a flow path to the production pipe.

In another preferred embodiment, the biomass may be ignited by means of introducing hot coals, injection of gaseous or liquid fuels, use of pyrophoric substances or electrical resistance heating.

Preferably, the hot product gas may be cooled and cleaned according to typical industry practice for biomass-derived syngas depending on the downstream application. Due to the long residence time and low velocities in the gasifier the production of heavy tar and particulates may be significantly lower than other biomass gasifiers. This reduces the cost and complexity of gas clean-up processes.

In one aspect, there is provided a method of biomass gasification whereby a large volume of biomass is loaded into a pit or containment structure and gasified in-situ in a batch process by igniting the biomass, injecting an oxidant through one or more injection pipes and collecting the syngas produced through one or more production pipes. The biomass may be ignited by means of introducing hot coals, injection of gaseous or liquid fuels (such as methane, liquid petroleum gas (LPG) or fuel oil), use of pyrophoric substances (such as silane or triethylborane) or by electrical resistance heating. The ignition of the biomass may be carried out manually prior to sealing the pit or containment structure or by remote means after sealing the pit such as injecting ignition fuels through the oxidant injection pipe or electrically activating an ignition device installed near the injection point. The oxidant injection pipe(s) may be located at the base of the biomass volume and comprises either a single injection point or multiple injection points. The injection point is fixed in place for the duration of the burn or is periodically retracted during the burn to expose fresh biomass for gasification. The injected oxidant may include air, air enriched with oxygen or pure oxygen with the possible addition of steam or water. The product syngas and production pipe may be cooled by quenching the syngas with water or by circulating cooling water through the production pipe. The biomass may be preheated and dried prior to ignition and gasification using waste heat by contacting the biomass with hot gases such as syngas, combustion exhaust gas or hot air or nitrogen.

In another aspect, there is provided a device for containing a biomass volume constructed by excavating a pit in the earth ideally of a rectangular shape and fitted with movable cover plates to allow access to the pit for loading the biomass and to seal the pit from the atmosphere and minimise heat loss from the pit during operation. The device may further include sides and base of the pit are either bare earth or covered or lined with suitable materials to prevent migration of gases or liquids from the pit. According to this aspect, the movable cover plates of the device for containing a biomass may substantially seal against a concrete foundation around the perimeter of the pit.

In a further aspect, there is provided a device for the oxidant injection pipe comprising, or consists of, either coiled tubing, flexible tubing, jointed pipe or welded pipe and contains a nozzle at the outlet of the pipe or multiple nozzles or holes distributed along the length of the pipe. The injection pipe may be placed inside a perforated outer pipe which extends to near the base of the production pipe.

In yet a further aspect, there is provided a device for the production pipe comprising, or consists of, a vertical or inclined steel pipe with an optional perforated section at its base.

In still a further aspect, there is provided a device for quenching a syngas, wherein the quench water is delivered via a quench pipe with a spray nozzle at the terminal end that injects the water into the syngas upstream of the inlet to the production pipe or injects the water inside the production pipe.

In still yet a further aspect, there is provided a device for cooling a production pipe, wherein the cooling water is circulated through the production pipe without directly contacting the syngas.

BRIEF DESCRIPTION OF THE DRAWINGS

In order that the present disclosure may be readily understood and put into practical effect, reference will now be made to embodiments of the present disclosure with reference to the accompanying drawings. The drawings are provided by way of example only, wherein.

Figure 1:
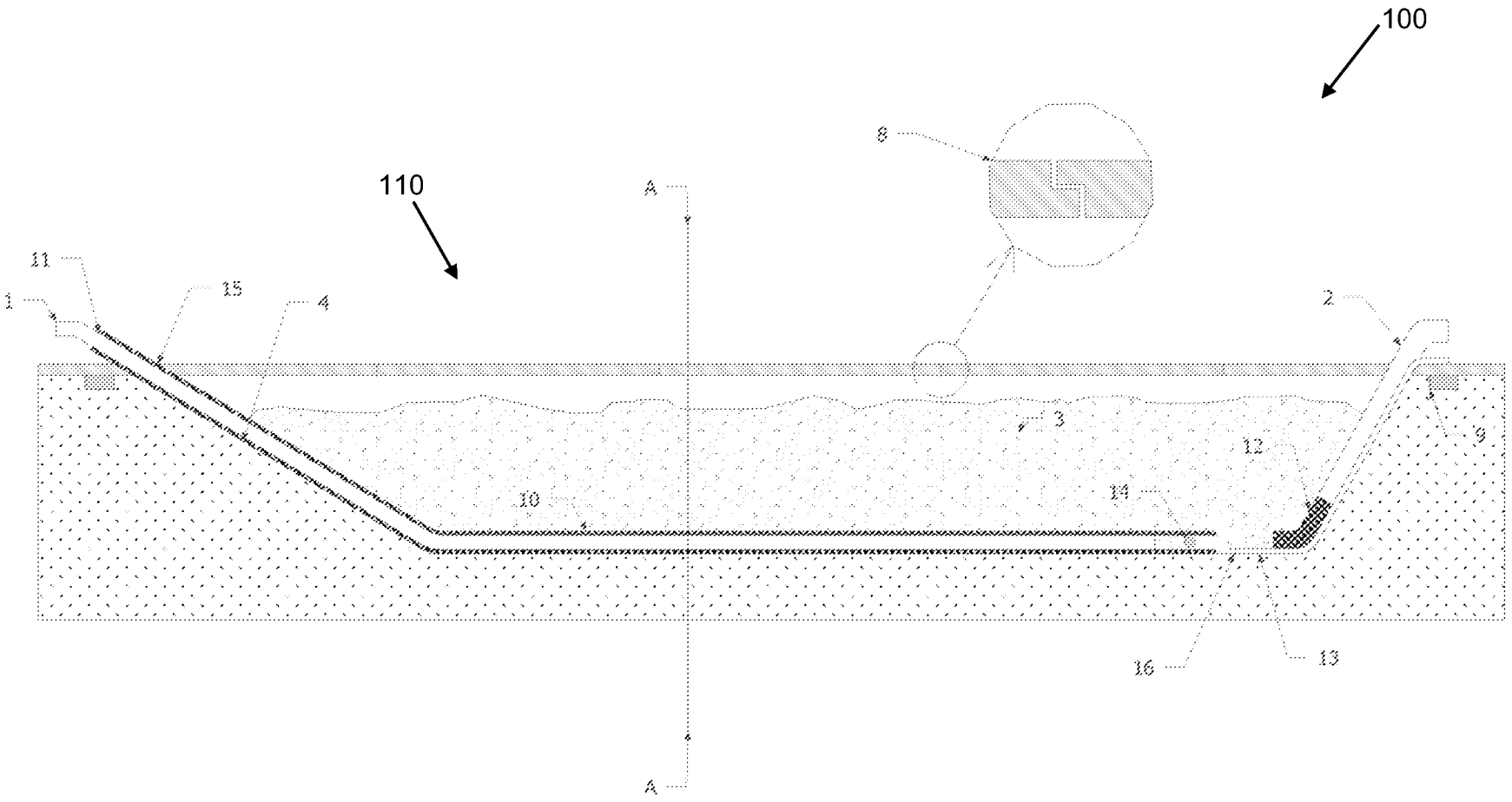
FIG. 1 is a side section of a biomass gasification pit according to an exemplary embodiment of the present disclosure.

Skilled addressees will appreciate that elements in the drawings are illustrated for simplicity and clarity and have not necessarily been drawn to scale. By way of example, the relative dimensions of some of the elements in the drawings may be distorted to help improve understanding of embodiments of the present disclosure.

DETAILED DESCRIPTION

The present disclosure relates generally to gasification of a combustible material. By "combustible material" is meant any material, or any combination of a plurality of materials, from a which a gas can be produced. The combustible material may be a carbonaceous material. In suitable embodiments, the combustible material may comprise a biomass material. The biomass material may be derived from a renewable energy source such as but not limited to, a plant-derived material or an animal-derived material. Non-limiting examples of plant-derived biomass material includes grasses (such as sugarcane, switch grass, and miscanthus, although without limitation thereto), tree species (such as Cyprus, oil palm, eucalyptus, bluegum, poplar, willow, and pine, although without limitation thereto), hemp, grains such as sorghum, corn husks, legumes such as pongamia, wood pellets, lumbering and timbering wastes, and garden waste. Plant-derived biomass material may be derived from agricultural sources. The combustible material may comprise a fossil fuel such as, but not limited to, coal. The combustible material may comprise, or be derived, from municipal waste, and it is contemplated that municipal waste may include a combination of combustible materials such as, but not limited to, a biomass material and a plastics material. In exemplary embodiments that contemplate a combustible material comprising a combination of a plurality of combustible materials, each combustible material may be in generally equal proportions, or alternatively, a proportion of one combustible material may exceed a proportion of another combustible material. By way of example only, a combustible material may be derived from municipal waste, which may comprise about 70 wt % of a biomass material, with a fraction of the remainder being a plastics material. The combustible material may include unprocessed, irregular and/or oversized material.

The terms "gas", "syngas", "synthetic gas" are used interchangeably herein to refer to a gas produced according to the methods of the present disclosure. The gas produced accordingly is particularly suitable for use in generation of power and electricity.

The present disclosure includes a batch method to gasify biomass by injecting air or oxygen into a confined volume of biomass and collecting the product gas. According to an exemplary embodiment in reference to FIGS. 1 to 3, the method includes loading, which may include collecting and storing, a biomass (3) in a pit (110) or other suitable containment structure. The containment structure according to any one of the methods or systems of the present disclosure is suitably configured to receive a combustible material. The containment structure according to any one of the methods or systems of the present disclosure may be in the form of a receptacle, a chamber, a cell, a pit, or a vessel. The containment structure according to any one of the methods or systems of the present disclosure may be rectangular in shape when viewed from above, although other shapes are contemplated.

Figure 2:
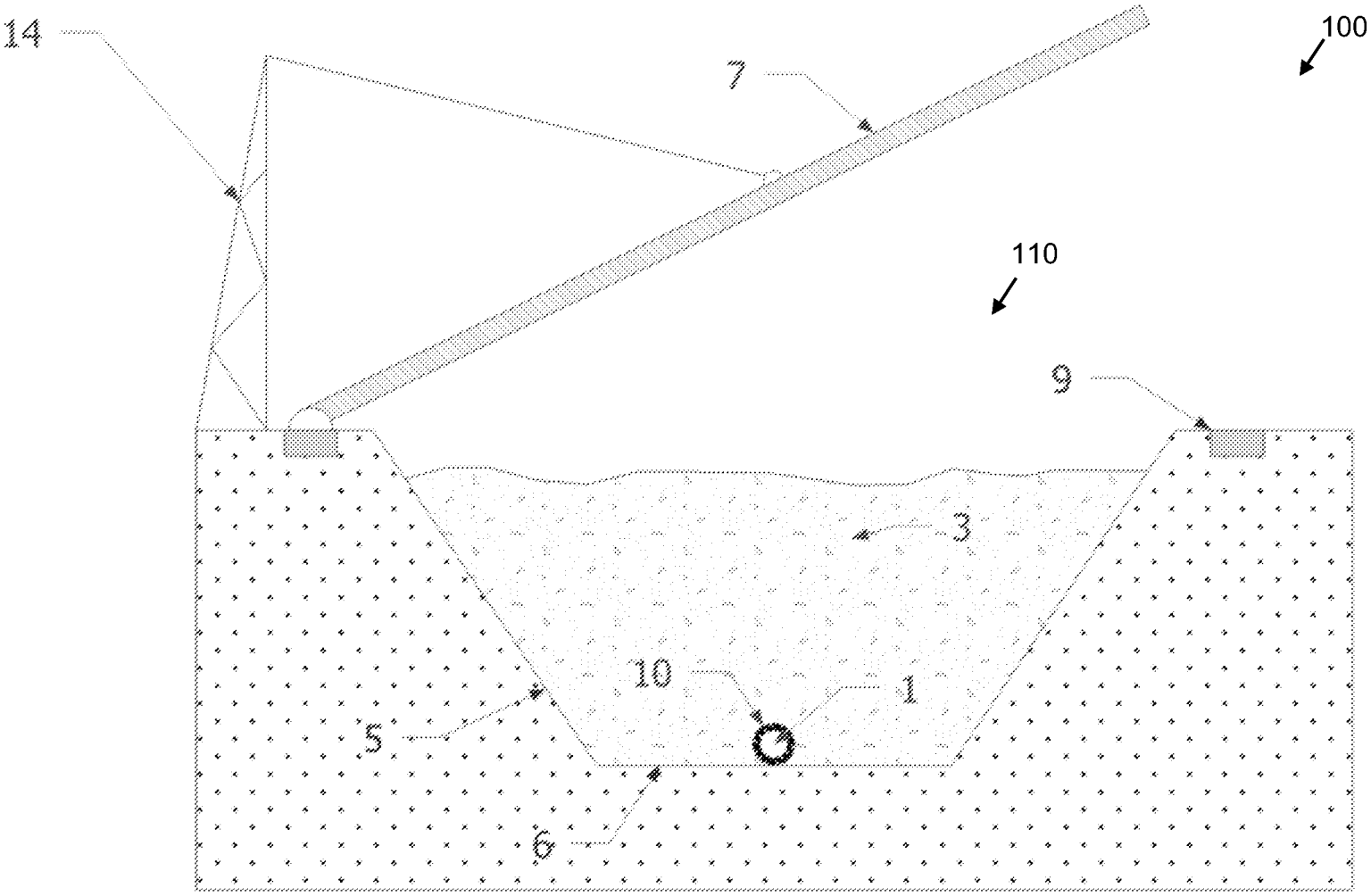
FIG. 2 is a front section view through lines A-A of the system shown in FIG. 1.
Figure 3:
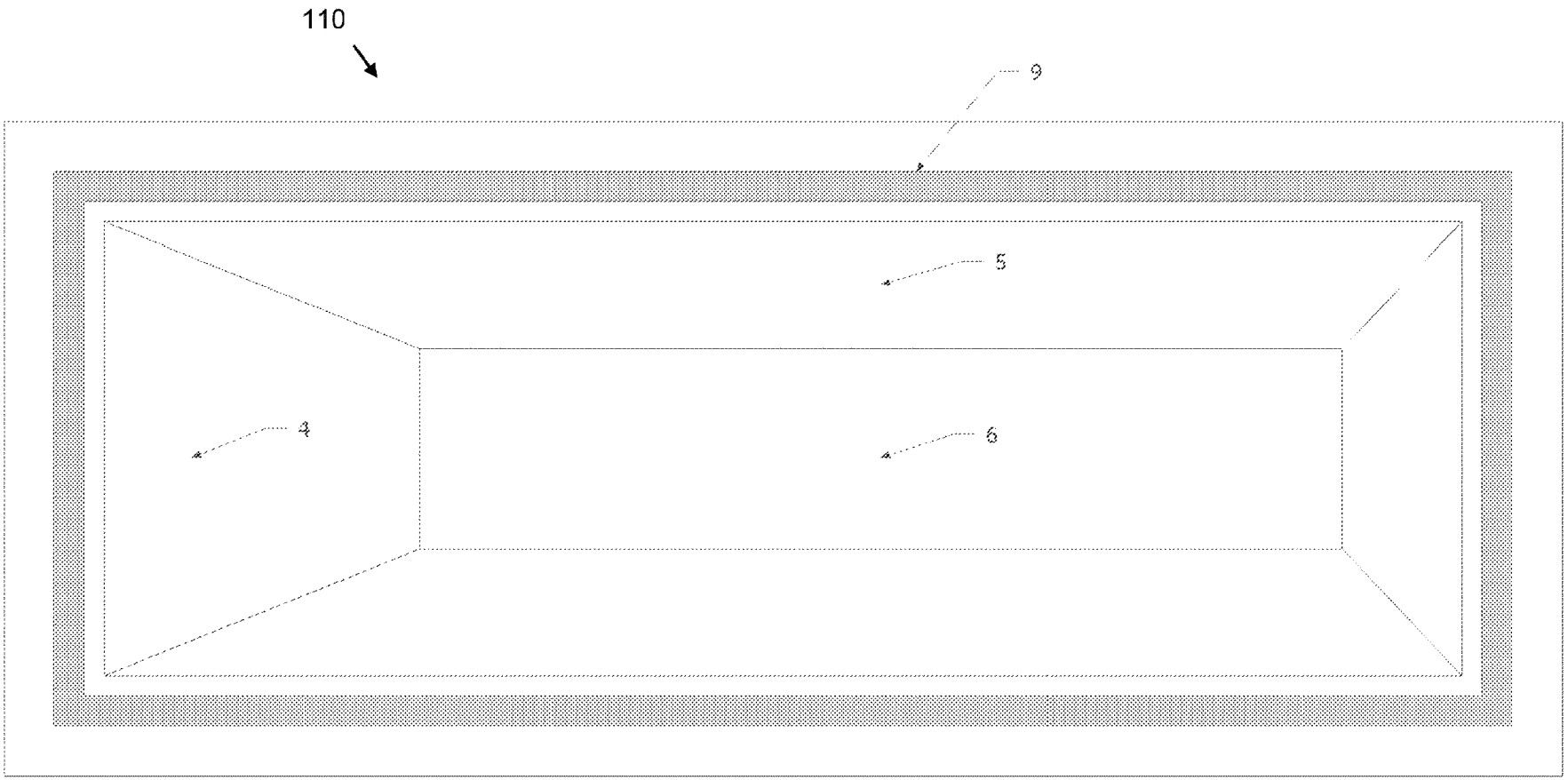
FIG. 3 is a top view of a containment structure of the system of FIG. 1.

Referring to FIGS. 1 to 3 for an example of a system 100 including a pit (110) configured for producing a gas from combustible material in the form of a biomass material (3). The biomass material (3) may be loaded into a pit (110) in an as-received condition or processed by chipping, grinding or compaction to increase the bulk density and homogeneity of the feedstock. The biomass material (3) may include unprocessed, irregular and/or oversized material. It will be appreciated that the biomass material (3) may include other components such as water or small amounts of other particulate material. By-product liquids separated from the syngas may also be recycled and mixed with the biomass (3) prior to gasification.

The system (100) includes a feeding mechanism, and in particular an oxidant feeding mechanism, in the form of an injection member configured to feed or inject an oxidant into the cell (110). Suitably, the oxidant is fed into the sealed containment structure, and preferably the cell (110) to contact the biomass material (3) at multiple points in a sequence. The injection member may be a duct, a conduit, a pipe, a tube, a channel, or the like. The injection member may be in the form of an injection pipe (1). Preferably, prior to filling the pit (110) with biomass feedstock (3), the injection pipe (1) and a production pipe (2) are installed to convey an oxidant and collect the product gas. The oxidant is fed into the sealed pit (110) to contact the biomass (3) at multiple points in a sequence.

Other equipment may also be installed including perforated steel liner pipes (10), ignition devices (14), cooling/quench water pipes (13) and monitoring devices such as thermocouples. Once the pit (110) is evenly filled with biomass (3) the top of the pit (110) may be closed off and all openings sealed from the atmosphere. An ignition sequence may be carried out by first establishing air flow from the injection pipe (1) to the production pipe (2) and then igniting the biomass (3) near an outlet of the injection pipe (1) using any suitable means which are described further herein.

Figure 4:
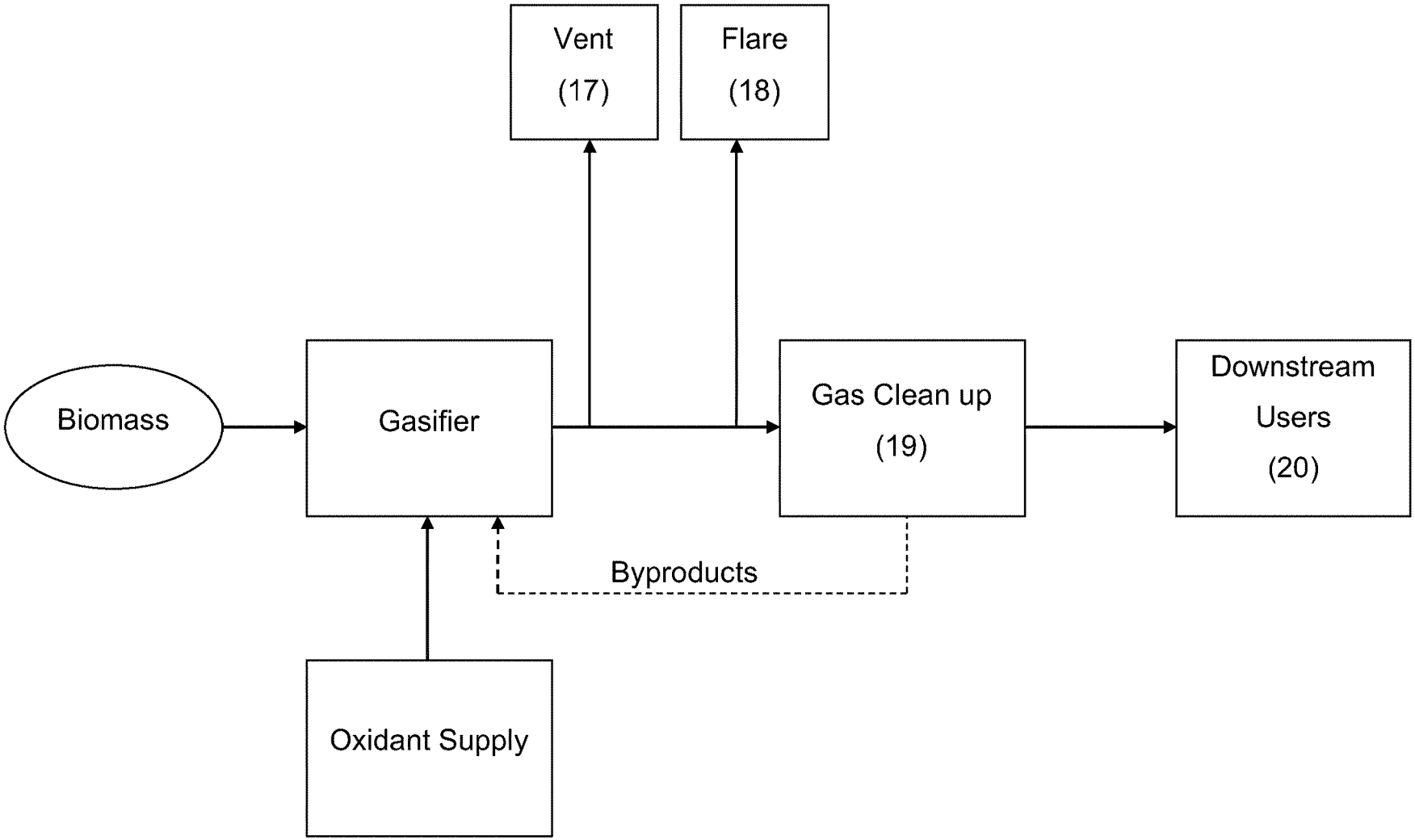
FIG. 4 shows a block flow diagram illustrating the incorporation of the present disclosure into an energy conversion facility.

Referring to FIG. 4, the product gas may initially be directed to a vent (17) during ignition due to the potential for oxygen in the gas and possibly explosive gas mixtures. Once positive ignition is confirmed and oxygen content in the product gas is below the safe limit the gas may be sent to a flare (18) and the oxidant injection rate may be increased to the normal design rate for gasification. Once the syngas quality is acceptable the syngas may be sent to downstream gas cleanup (19) and end users (20). A suitable injection rate is dependent on the size of the pit (110), the required gas production rate and the kinetic limitations of the gasification process including heat and mass transfer limitations and the reactivity of the biomass.

Typically, the highest temperatures occur near the injection point due to combustion of biomass and syngas surrounding the injection point. Heat generated from exothermic reactions causes drying and pyrolysis of the biomass surrounding and downstream of the combustion zone which turns to char and the char is converted to syngas by gas-solid reactions including reactions with $H_2$, $CO_2$ and $H_2O$. Gas-phase reactions also occur including water gas shift and methanation reactions. The syngas naturally cools as it flows towards the production pipe, however further cooling of the gas may be required due to material limitations in the production piping and downstream equipment. The hot product gas is typically comprised of a mixture of $N_2$, $H_2$, CO, $CO_2$, $CH_4$, $H_2O$, tars and other minor constituents.

During normal operation the product gas is directed to the gas clean-up equipment (19) and downstream users (20). The gasifier operating pressure and product gas pressure is near to atmospheric to avoid gas leakage and air ingress to the pit (110). Once the fuel surrounding the injection point is consumed the gasification efficiency drops and product gas quality is degraded. In order to maintain high gas quality the injection point may be periodically or continuously retracted to consume fresh biomass. The product gas flow rate and composition may be controlled by varying the oxidant injection rate, composition and injection location. In the event that the gasifier needs to be shut down, the oxidant injection may be ceased and excess product gas is flared. The methods of the present disclosure may include ceasing oxidant injection to extinguish a gasification reaction. If required, water may be injected to quench and cool the gasifier after ceasing oxidant injection. Once the biomass is consumed the pit (110) is purged and cooled with air or nitrogen and the purged gas is flared. Purging with air can oxidise any noxious combustible gases and liquids, however care must be taken to ensure that explosive mixtures are not formed. Once the pit (110) atmosphere is safe the top of the pit (110) is opened to allow re-instatement of equipment and refilling with the combustible material in the form of a biomass material. The process is conducted in batches and requires at least two pits to maintain continuous gas production, wherein one pit is in service while the other pit is being filled with biomass and prepared. Any residual biomass remaining in the pit (110) after gasification can be left in place to be consumed in the next burn. Ash left behind after consumption of the biomass will be retained in the pit (110) and will build up after each burn requiring periodic removal. Typical commercial syngas production rates from a biomass gasifier can range from about 300 Nm3/h to about 5000 Nm3/h and the typical rate of biomass consumption can range from about 2 t/d to about 100 t/d.

The present disclosure includes a design for the gasifier containment structure including its associated equipment. A pit dug into the earth is proposed as a cost effective thermal containment structure for the biomass, however other designs are possible such as structures located on the surface fabricated from common engineering materials including steel, concrete and refractory. Advantages of using a pit include a low cost means for creating a large storage volume, the loading point is located at grade and the insulating properties of the surrounding earth. Referring to FIGS. 1, 2 and 3, the pit (110) is ideally constructed by excavating a long rectangular channel with sloping sides to provide stability and avoid the need for costly retaining methods which may not be suitable for exposure to high temperatures. The use of sloping sides also makes for easier construction and during operation the biomass will fall towards the injection point under gravity. However vertical sides may be preferable for certain soil types to minimise the span of the cover plates. Easy access to the pit (110) may be required to perform maintenance after each burn and can be provided by a ramp on the injection side (4) leading to the base of the pit (110). The dimensions of the pit (110) will depend on the soil geotechnical properties and the required fuel volume. A larger pit will provide a longer burn time however the capital cost will be higher than a smaller pit. Increased storage volumes may be primarily achieved by increasing the length of the pit (110). Typical storage volumes for the pit (110) can range from about 100 $m^3$ to about 10,000 $m^3$. Typical burn times can range from about 1 week to about 10 weeks, although without limitation thereto. Typical dimensions for commercial sized pits can range from a width of about 2 metres to about 10 metres, a depth of about 2 metres to about 10 metres and a length of 20 metres to several hundred metres.

The sides (5) and base (6) of the pit (110) may be simply bare earth or may be lined with materials such as clay, geomembranes, concrete, refractory or steel to prevent migration of liquids or gases from the pit (110) and to prevent erosion and collapse of the sides of the pit (110). When employing bare earth construction, locations with permeable soils or high groundwater levels should generally be avoided to prevent water ingress and loss of gases or liquids into the soil.

Liquid by-products may be produced from biomass gasification which, while being generally less toxic than those produced from fossil fuel gasification, may still be harmful to the environment. The pit (110) may be configured to prevent by-product liquids from escaping from the pit (110). The high temperatures developed in the pit (110) typically ensure that by-product liquids are in the vapour phase and removed with the product gas. Unconverted biochar will also likely be present in the pit (110) which can absorb by-product liquids. With proper site selection, design and operation no significant amounts of by-product liquids may be expected to be absorbed into the soil and may not expected to cause harm to the environment or require remediation. If required, plastic geomembranes can be installed under the base of the pit (110) to provide a barrier for liquids that may drain under gravity from the pit (110), similar to those used for landfill applications. Natural products such as clay may also be used, however shrinkage and cracking due to high temperatures must be considered. Similarly, any concrete layers and slabs must be suitable for high temperature exposure.

At least a portion of the top of the pit (110) should be open during the filling stage and should be substantially sealed off from the atmosphere during the gasification stage. A top cover can be in the form of a movable cover plates (7) of hinged, sliding or loose design and made of non-combustible materials such as steel, concrete or refractory may be used to seal the top of the pit (110). Hinged cover plates have the advantage of minimising the footprint and can be raised or lowered using winches (14) instead of mobile cranes. In addition to sealing the pit (110) from the atmosphere the covers are also used to reduce the heat loss from the pit (110) and therefore must have insulating properties. The cover plates are typically exposed to high temperature syngas and require appropriate materials such as high temperature rated cement or refractory. In order to create a seal between the cover plates the edges can be profiled (8) to incorporate sealing surfaces which are sealed using a suitable filler material.

A relatively gas-tight seal is required to prevent air ingress or gas leakage from the pit (110) during gasification. A concrete foundation (9) around the perimeter of the pit (110) may be used to create an effective sealing surface between the cover plates and the earth. A sealing strip of suitable material may be applied between the cover plates and the concrete perimeter foundation. Alternatively, it may be possible to seal directly onto the earth or by using a channel filled with water to create a dip seal.

An injection pipe (1) is preferably installed along at least a portion of the base of the pit (110) and is aligned along the axis of the pit (110). The injection pipe is used to feed or convey the oxidant which may be air, oxygen or a mixture thereof. Air or oxygen may be supplied by any suitable means such as air blowers or air compressors and oxygen production or enrichment by membranes, vacuum/pressure swing adsorption or cryogenic air separation. The oxidant may be preheated to improve gasification efficiency using waste heat from the raw syngas or from downstream sources. Water or steam may also be injected along with the oxidant as gasification reagents or for cooling purposes. The injection pipe is preferably made of carbon or alloy steel. Suitable designs for the injection pipe include coiled tubing (as used in oil and gas applications), flexible tubing or jointed pipe (using flanges, threaded couplings or clamps) to provide a means to retract or shorten the injection pipe and thus reposition the injection point within the gasifier. Methods for retracting the injection point may include shortening the injection pipe by removing jointed sections, intentional destruction of joints by heat or mechanical means, burning through the injection pipe using a burner inserted in the injection pipe or by reeling in a coiled tubing or flexible tubing. Due to the low operating pressure the size of the injection pipe may be too large for coiled tubing, therefore the preferred design uses jointed pipe or flexible tubing. Reuse of the injection pipe will lower the operating costs, therefore it is preferred to retract the pipe by mechanical means and remove jointed sections to shorten the pipe. A nozzle may be fitted to the end of the injection pipe to increase the velocity or disperse the oxidant exiting the pipe and promote more efficient mixing and gasification. Depending on the width of the pit (110), multiple injection pipes may be used to improve distribution of the oxidant. Typical air injection rates for commercial applications can range from about 100 to about 3000 Nm3/hr depending on the pit (110) dimensions, biomass reactivity and desired gas production rate.

An alternative injection pipe design involves a fixed or retractable pipe which contains a series of holes or nozzles along its length creating multiple simultaneous injection points. If the nozzles are located along the entire length of the injection pipe then the gasification process can proceed evenly along the length of the gasifier and retraction of the injection point is not required. A fixed injection pipe does not require joints and may be fully welded. This design also has the benefit of creating an extended high temperature zone along the length of the gasifier resulting in greater destruction of tars. Syngas produced at injection points near the inlet of the gasifier flows towards the production pipe and is reheated as it passes through other injection points located downstream. This design can also be used to create an injection point near the outlet of the gasifier to increase the syngas temperature and promote thermal destruction of tars.

In one embodiment, the injection pipe is located inside a perforated liner pipe (10) in order to prevent friction on the injection pipe during retractions due to the weight of biomass on the pipe and to maintain a flow path to the production pipe. The perforated liner (10) may be made from carbon or alloy steel and may have perforations in various patterns and various hole shapes and sizes. Typically the perforations are staggered and provide an equivalent open area in the range of 30% to 80%. The perforated liner (10) may extend up to the end of the injection pipe or it may extend all the way to the base of the production pipe and may be connected to the base of the production pipe. The perforated liner (10) may include solid sections to seal off the overlying biomass from the injection pipe at desired locations and to create a seal at the point (15) where the perforated liner (10) exits the pit (110). A dynamic seal (11) between the injection pipe and the liner is also required near the inlet to the pit (110) to prevent air ingress and syngas leakage through the annulus during retractions.

At least one production pipe (2) is installed at the opposite end of the gasifier to the injection end. The production pipe may be vertical or inclined and shall be designed to handle high temperature product gas from the gasifier at temperatures typically ranging from about 200° C. to about 700° C. The production pipe may be made of carbon or alloy steel with welded or threaded joints. The base of the production pipe may be perforated to avoid blockages (12). If required the product gas may be cooled by injection of water directly into the gas or by circulating cooling water through a double walled production pipe. Direct injection of water is simpler and less costly than indirect cooling, however this increases the moisture content of the gas which results in additional condensate produced when cooling the gas. Wastewater produced from gas cooling and clean up may be substituted for fresh water depending on the wastewater properties. Depending on the dimensions of the pit (110), multiple production pipes may be required.

Direct injection of water into the gas may be accomplished by a quench pipe (13) which conveys water to the base of the production well and injects water via a spray nozzle (16) either upstream of the production pipe or inside the inlet of the production pipe. The spray nozzle is sized to produce a sufficiently fine spray of water to cause rapid evaporation and cooling of the gas to the desired temperature within a certain distance.

The initial ignition of the biomass may be achieved by various means including introducing hot coals, injection of gaseous or liquid fuels (such as methane, LPG or fuel oil, but without limitation thereto), use of pyrophoric substances (such as a silane or a triethyleneborane gas, but without limitation thereto), or electrical resistance heating. Ignition sources may be inserted through the injection or production pipes or via a separate ignition pipe. The biomass may also be ignited by introducing hot coals or using a burner with an extended handle prior to closing the final cover plate. Once ignited the process is self sustaining and does not require additional ignition energy sources. However, if the combustion zone is extinguished then re-ignition may be required using similar methods to the initial ignition.

In a further embodiment, the hot product gas may be cooled and cleaned according to typical industry practice for biomass-derived syngas. Due to the long residence time and low velocities in the gasifier the production of heavy tar and particulates may be significantly lower than other biomass gasifiers. This reduces the cost and complexity of gas clean-up processes.

In certain preferred embodiments, in order to improve thermal efficiency the biomass may be pre-heated and dried prior to gasification using waste heat from product gas or downstream processes such as power generation. This can be achieved by contacting the biomass charge with hot syngas, combustion exhaust gases or preheated air to evaporate excess moisture. The heating/drying medium can be introduced into the biomass through the oxidant injection pipe or other distribution pipes specifically installed for this purpose.

Figure 5:
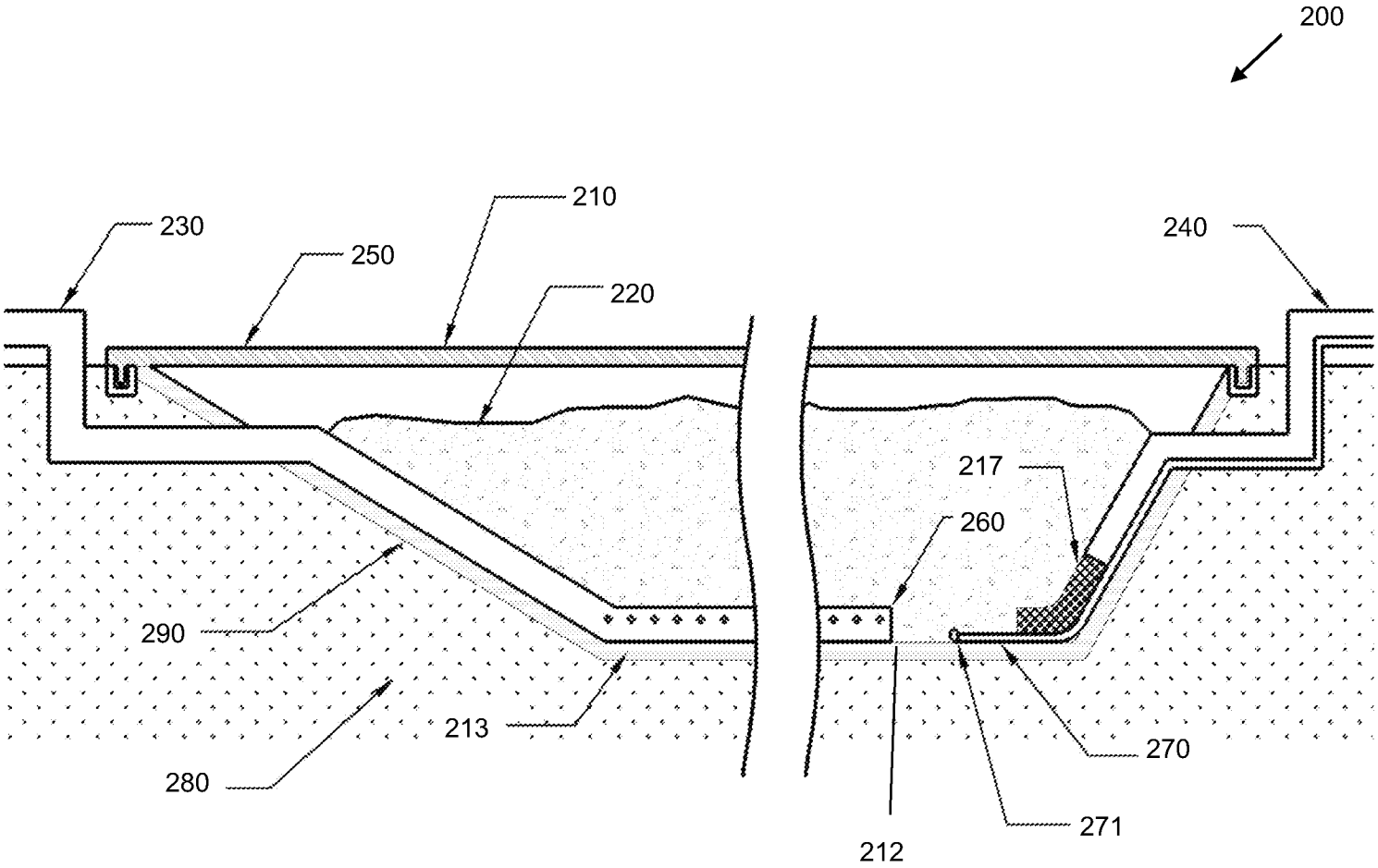
FIG. 5 is a cross-sectional side view of a method and a system according to another exemplary embodiment of the present disclosure.
Figure 6:
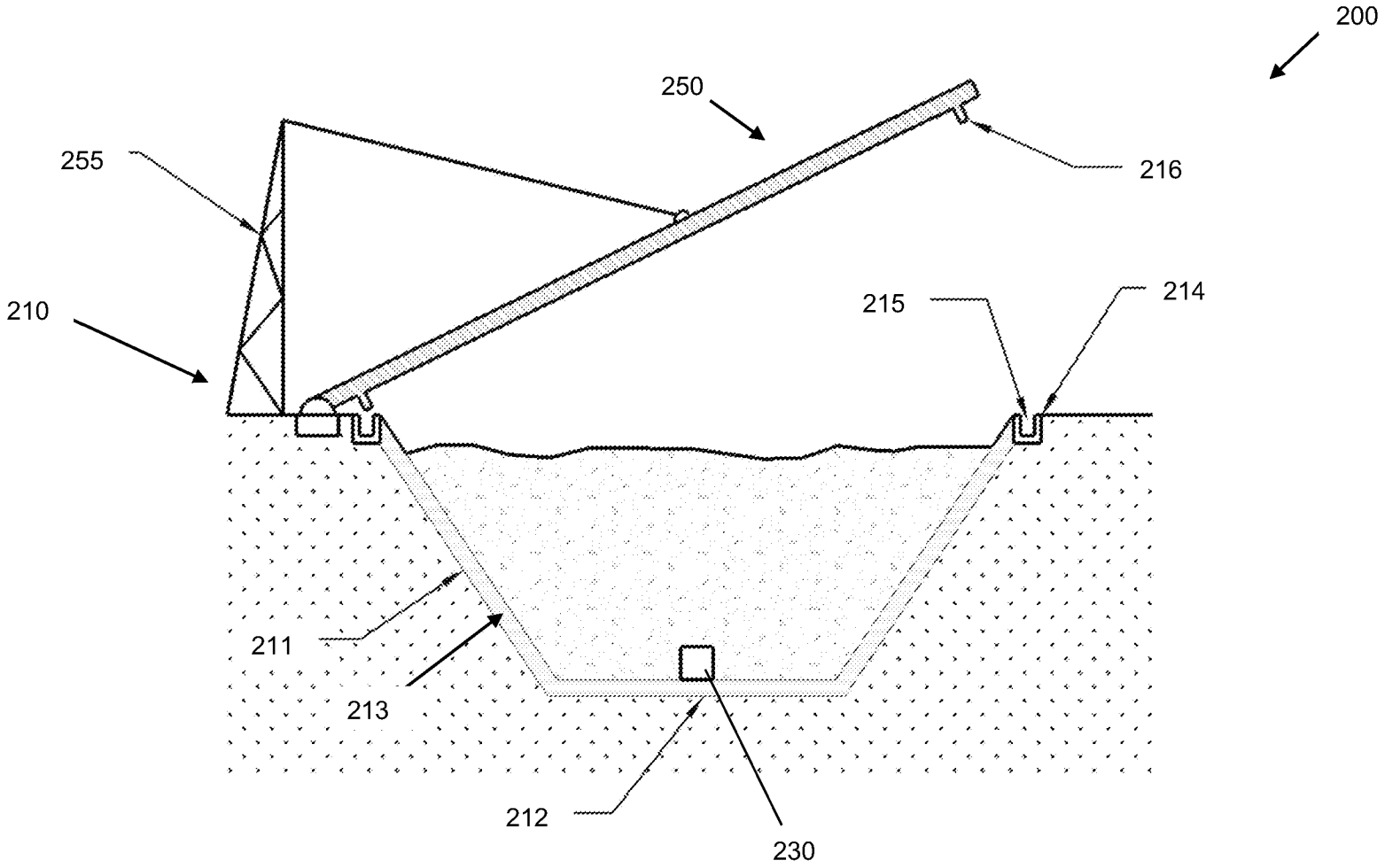
FIG. 6 is a cross-sectional end view of the system shown in FIG. 5.

Reference is now made to FIGS. 5 and 6, which depict a further exemplary embodiment of the present disclosure. In particular, FIGS. 5 and 6 depict a method and a system (200) according to the present disclosure. The system (200) includes a containment structure. The containment structure is suitably configured to receive a combustible material. The containment structure may be in the form of a receptacle, a chamber, a cell, a pit, or a vessel. The containment structure is preferably rectangular when viewed from above, although other shapes for the containment structure are contemplated. The system (200) include a containment structure in the form of a cell (210) and a ramp (290) to provide access to the cell (210), which is useful for maintenance. Referring in particular to FIG. 6, sides (211) and base (212) of the cell (210) may be bare earth, or alternatively may have a liner (213) formed from materials such as clay, geomembranes, concrete, refractory or steel to prevent migration of liquids or gases from the cell (210) and to prevent erosion and collapse of the sides of the cell. The liner (213) may be formed from geomembranes.

According to this embodiment, the cell (210) is formed by excavation into the earth (280). This type of formation is a cost effective thermal containment structure for biomass, however other designs are contemplated such as, but not limited to, structures located on the surface fabricated from common engineering materials including steel, concrete and refractory. Non-limiting advantages of using a containment structure formed by excavation includes a low cost means for creating a large storage volume, a loading point is located at grade and the insulating properties of the surrounding earth. Preferably, the cell (210) is a rectangular channel with sloping sides. Suitably, sloping sides provide stability and avoid the need for costly retaining methods which may not be suitable for exposure to high temperatures. The use of sloping sides may facilitate construction, and during operation the biomass will fall towards the injection duct under gravity. However, vertical sides may be preferable for certain soil types to minimise the span of the top cover(s). One or more dimensions of the containment structure may depend on the desired width:height ratio for gasification, soil geotechnical properties and the required fuel volume, although without limitation thereto. By way of example only, a larger cell will provide a longer run time however the capital cost will be higher than a smaller cell. In certain embodiments, the depth of the containment structure may generally be limited by excavation costs, water table levels and span width at the top of the cell. The width of the cell may generally be limited by methods required to fill the containment structure substantially evenly with a biomass material. For example, direct dumping of a biomass material from one side may limit the width of the cell to between about 3 metres to about 6 metres. Therefore, increased storage volumes may be achieved by increasing the length of the containment structure. Exemplary storage volumes for the containment structure can range from about 100 $m^3$ to about 10,000 $m^3$. Typical gasification run times can range from a few days to a few weeks, although without limitation thereto. Typical dimensions for commercial sized containment structures can range from a width of about 2 metres to about 10 metres, a depth of about 2 metres to about 10 metres and a length of 20 metres to several hundred metres.

A combustible material that may be in the form of a combustible material comprising a biomass material (220) may be loaded into the cell (210) in an as-received condition or alternatively, processed by chipping, grinding or compaction to increase the bulk density and homogeneity as hereinbefore described. The biomass material (220) may include unprocessed, irregular and/or oversized material. It will be appreciated that the biomass material (220) may include other components such as water or small amounts of other particulate material. Prior to loading or filling the cell (210) with the biomass material (220), an injection duct (230) and a production pipe (240) may be installed to convey an oxidant and collect a product gas respectively. Once the cell (210) is loaded with the biomass material (220), the cell (210) is substantially sealed. In particular, a top cover (250) is closed off and all openings are sealed or substantially sealed from the atmosphere. An ignition sequence is performed at the ignition point (260) by first establishing air flow from the injection duct (230) to the production pipe (240), and subsequently igniting the biomass material (220) using any suitable mechanism as described herein. Preferably, the biomass material (220) is ignited near or at one end of the cell (210). The present disclosure contemplates that the system (200) may include other components such as ignition devices, cooling/quench water pipes (270) and monitoring devices such as thermocouples, although without limitation thereto.

The top of the cell (210) is at least partially open during loading of the biomass material (220) into the cell (210) and the cell (210) is substantially sealed, and preferably completely sealed, from the atmosphere during the gasification stage. The top cover (250) may cover the cell (210), and may cover the top of the cell (210). The top cover (250) is preferably movable. The top cover (250) may be hinged, sliding or loose design. The top cover (250) is preferably formed from a non-combustible heat resistant material such as steel, concrete or refractory, although without limitation thereto. The top cover (250) can be raised or lowered using an opening mechanism (255) such as a powered winch or hydraulic arm. In addition to sealing the cell (210) from the atmosphere, the top cover (250) may also reduce the heat loss from the cell (210) and accordingly, the top cover (250) may have insulating properties. The top cover (250) may be formed from materials able to withstand exposure to high temperature syngas such as high temperature rated steel or refractory, although without limitation thereto.

A gas-tight seal prevents or minimises substantial air ingress or gas leakage from the cell (210) during gasification. As shown in particular in FIG. 6, a concrete foundation (214) around the perimeter of the cell (210) supports the top cover (250) and incorporates a channel (215). The channel (215) may be filled with water into which a dip seal plate (216) installed on the top cover (250) is inserted to create a water seal. A water seal is a reliable sealing method for low pressure applications and avoids sealing materials which can degrade over time with repeated use. Alternatively, a sealing strip of suitable material may be applied between the top cover (250) and the concrete foundation (214).

Referring in particular to FIG. 5, the methods of the present disclosure and the system (200) includes a feeding mechanism, and in particular an oxidant feeding mechanism, in the form of an injection member configured to feed or inject an oxidant into the cell (210). Suitably, the oxidant is fed into the sealed containment structure, and preferably the cell (210) to contact the biomass material (220) at multiple points in a sequence. The injection member may be a duct, a conduit, a pipe, a tube, a channel or the like. The injection member may be in the form of an injection duct (230). In the depicted embodiment, the injection duct (230) is positioned along a portion of the base (212) of the cell (210), and may be aligned along an axis of the cell (210). The injection duct (230) feeds an oxidant to the sealed cell (210). The oxidant may be air, oxygen, or a mixture thereof. Air or oxygen may be supplied by any suitable means such as air blowers or air compressors, oxygen production, enrichment by membranes, vacuum/pressure swing adsorption, or cryogenic air separation. The oxidant may be preheated to improve gasification efficiency using waste heat from the raw syngas or from downstream sources. Water, steam or tar-water mixture may also be injected along with the oxidant as gasification reagents or for cooling purposes. The injection duct (230) is preferably made of carbon or alloy steel. The injection duct (230) may be movable or displaceable, or may be fixed in place with nozzles which can be opened and closed to enable the oxidant injection point location to be moved during operation, as will be described herein. Suitable designs for a movable injection duct include coiled tubing (as used in oil and gas applications), flexible tubing or jointed pipe (using flanges, threaded couplings or clamps) to provide a mechanism to retract or shorten the injection duct (230) and thus reposition the oxidant injection point within the gasifier.

In general, a biomass material used as a feedstock may have a high moisture content which may range from about 10 wt % to in excess of about 50 wt %. Accordingly, after the biomass material (220) has been loaded in the cell (210), it may require drying to reduce the moisture content to a desired level (generally, although not exclusively, below 20 wt %) to avoid generation of excess moisture and condensate in the product gas. A heating/drying medium can be introduced into the biomass material (220) through the injection duct (230) or through a dedicated drying duct (not shown) to facilitate drying.

Initial ignition of the biomass material (220) may be achieved by various mechanisms including introducing hot coals, injection and combustion of gaseous or liquid fuels (such as methane, liquid petroleum gas (LPG) or fuel oil, but without limitation thereto), use of pyrophoric substances (such as a silane or a triethyleneborane gas, although without limitation thereto), or electrical resistance heating, although without limitation thereto. Ignition sources may be introduced through the injection duct (230), the production pipe (240), or via a separate ignition pipe (not shown). Once ignited, the process may be substantially self-sustaining and generally does not require additional ignition energy sources. However, if the combustion zone is extinguished then re-ignition may be required using similar methods to the initial ignition.

It will be understood that the highest temperatures may occur near the injection point due to combustion of biomass and syngas surrounding the injection point. Heat generated from exothermic reactions causes drying and pyrolysis of the biomass in and around the combustion zone, which causes it to turn to char. The char is subsequently converted to syngas by gas-solid reactions including reactions with $H_2$, $CO_2$ and $H_2O$. Gas-phase reactions also occur including water gas shift and methanation reactions. The syngas naturally cools as it flows towards the production pipe (240), however further cooling of the gas may be required due to material limitations in the production piping and downstream equipment. The hot product gas is typically comprises a mixture of $N_2$, $H_2$, CO, $CO_2$, $CH_4$, $H_2O$, tars, and other minor constituents.

As mentioned herein, the present disclosure contemplates systems and methods that include a movable injection member. Particularly, the oxidant injection point may be moved by the movable injection member. The movable injection member may be a movable duct. Methods for moving the oxidant injection point of the movable duct may include shortening the injection duct (230) by removing jointed sections, intentional destruction of joints by heat or a mechanical mechanism, burning through the injection duct (230) using a burner inserted in the injection duct (230) or by reeling in a coiled tubing or flexible tubing. Due to the low operating pressure, the size of the injection duct (230) may be too large for coiled tubing, therefore it is contemplated that a jointed pipe or flexible tubing may be employed. Reuse of the injection duct (230) will typically lower the operating costs, therefore it is preferred to retract it by mechanical means and remove jointed sections to shorten the pipe. Holes and nozzles may be drilled or fitted to the injection duct (230) to direct the oxidant in different directions, increase the velocity or disperse the oxidant exiting the pipe and promote more efficient mixing and gasification. Depending on the width of the cell (210), a plurality of injection ducts (230) may be used to improve distribution of the oxidant. Typical air injection rates for commercial applications can range from about 100 Nm3/hr to about 3000 Nm3/hr depending on the cell (210) dimensions, biomass reactivity and desired gas production rate.

In an exemplary embodiment, a movable injection duct may be positioned inside a perforated liner in order to prevent friction on the movable injection duct during retractions due to the weight of the biomass material (220) on the pipe and to maintain a flow path to the production pipe (240). An exemplary perforated liner designated with reference numeral (10) is shown in FIG. 1. The perforated liner may be made from carbon or alloy steel and may have perforations in various patterns and various hole shapes and sizes. Typically, the perforations are staggered and provide an equivalent open area in the range of about 30% to about 80%. The perforated liner may extend up to the end of the movable injection duct or it may extend all the way to the base of the production pipe (240) and may be connected to the base of the production pipe (240). The perforated liner may include solid sections to seal off the overlying biomass from the injection duct at desired locations and to create a seal at the point where the liner exits the cell. A dynamic seal between the movable injection duct and the liner is also required near the inlet to the cell to prevent air ingress and syngas leakage through the annulus during retractions.

Alternatively, injection duct (230) may be in the form of a fixed pipe or duct which contains a series of oxidant outlets that may be in the form of holes or nozzles along its length, which can be independently opened and closed via valve mechanisms. The valves may be installed close to the nozzles within the injection duct (230) or outside of the cell (210) on individual oxidant supply pipes that run to each nozzle. The advantage of installing the valves outside of the cell (210) is the lower design operating temperatures and easier access for maintenance and replacement. By opening some valves and closing others in sequence, the oxidant injection point can be moved through the cell (210) in a manner similar as achieved by a movable injection duct.

In further alternative embodiments, the injection duct (230) may be a fixed or retractable pipe including a series of holes or nozzles along its length creating multiple simultaneous injection points. If the nozzles are located along the entire length of the injection duct then the gasification process may proceed evenly along the length of the gasifier and retraction of the injection point is typically not required. A fixed injection duct may not require joints and may be fully welded. This design also has the benefit of creating an extended high temperature zone along the length of the gasifier resulting in greater destruction of tars. Syngas produced at injection points near the inlet of the gasifier flows towards the production pipe (240) and is reheated as it passes through other injection points located downstream. This design can also be used to create an injection point near the outlet of the gasifier to increase the syngas temperature and promote thermal destruction of tars.

The cell (210) includes at least one production pipe (240) for the transport of gas from the cell (210). The present disclosure contemplates embodiments where the cell (210) includes a plurality of production pipes (240). The need for a plurality of production pipes (240) may depend on the dimensions of the cell (210), although without limitation thereto. The production pipe (240) may be vertical or inclined and shall be designed to handle high temperature product gas from the gasifier at temperatures typically ranging from about 200° C. to about 700° C. The production pipe (240) may be made of carbon or alloy steel with welded or threaded joints. The base of the production pipe (240) may have a perforated section (217) to avoid blockages. If required, the product gas may be cooled by injection of water directly into the gas, or alternatively by circulating cooling water through a double walled production pipe. Wastewater produced from gas cooling and clean up may be substituted for fresh water depending on the wastewater properties. Referring to FIG. 5, direct injection of water into the gas may be accomplished by a quench pipe (270) which conveys water to the base of the production well and injects water via a spray nozzle (271) either upstream of the production pipe (240) or inside the inlet of the production pipe (240). The spray nozzle (271) is sized and configured to produce a sufficiently fine spray of water to cause rapid evaporation and cooling of the gas to the desired temperature within a certain distance.

Figure 7:
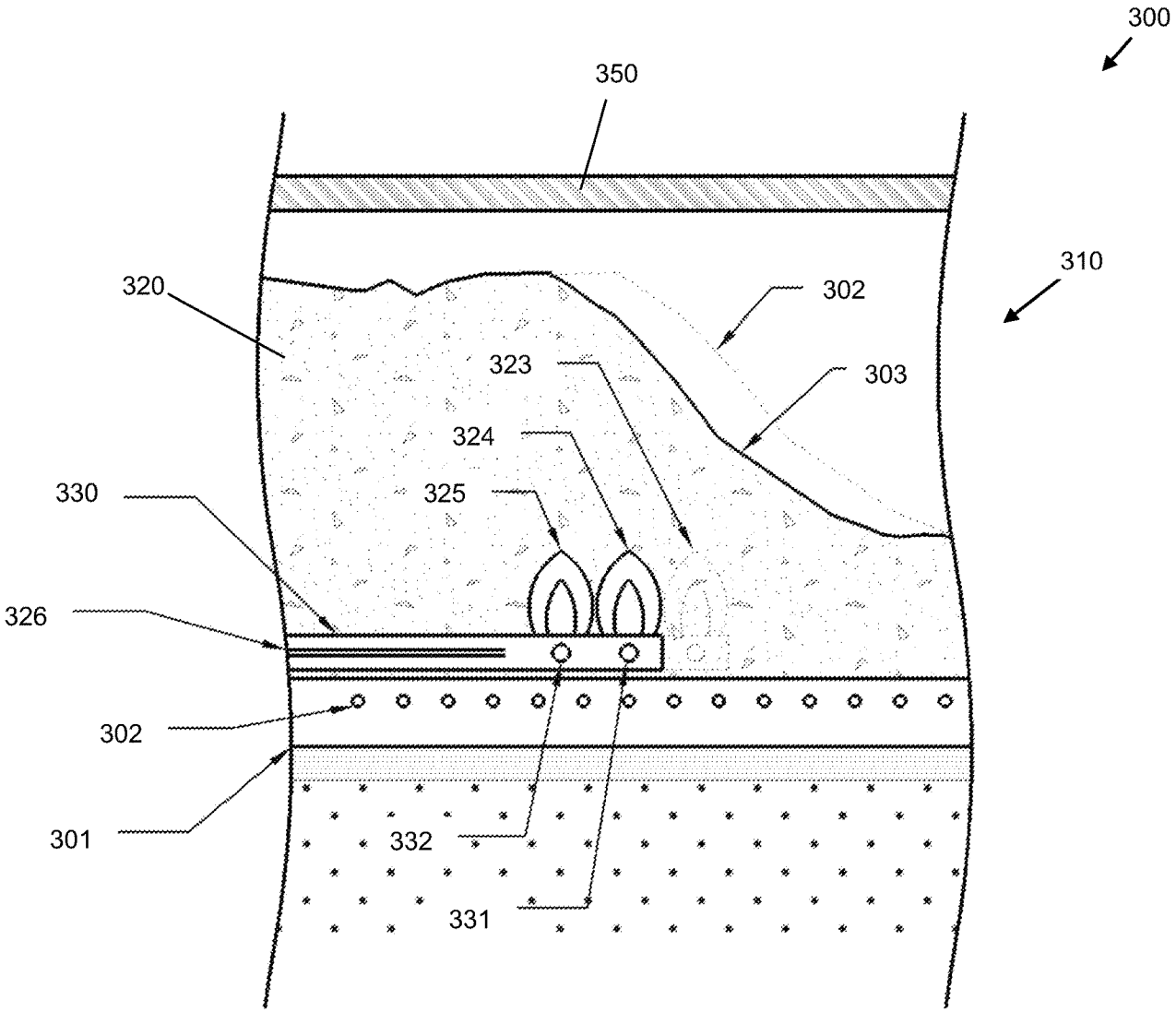
FIG. 7 is a cross-sectional side view of a method and a system according to a further exemplary embodiment of the present disclosure.

Referring to FIG. 7, there is shown a system (300) for performing a method of the present disclosure according to an exemplary embodiment. The system includes a containment structure. The containment structure is suitably configured to receive a combustible material. The containment structure according to any one of the methods or systems of the present disclosure may be in the form of a receptacle, a chamber, a cell, a pit, or a vessel. The system (300) includes a containment structure in the form of a cell (310), a top cover (350) to substantially seal the cell (310), and a combustible material in the form of a combustible material comprising a biomass material (320) as described herein. The cell (310) is rectangular in shape when viewed from above, although other shapes are contemplated by the present disclosure. The biomass material (320) may include unprocessed, irregular and/or oversized material. It will be appreciated that the biomass material (320) may include other components such as water or small amounts of other particulate material. The system (300) includes a drying duct (301) that is preferably positioned along at least a portion of the base of the cell (310). The drying duct (301) includes holes and nozzles (302) spaced along its entire length. It is contemplated that at least a portion of the drying duct (301) may include holes and nozzles (302). A drying medium, being preferably hot air or steam, may be introduced uniformly over the biomass material (320) through the drying duct (301). Preferably, the drying medium is introduced uniformly over the biomass material (320). The drying medium can be used to evaporate moisture from the biomass material (320) and remove it from the cell (310) as water vapour, where it can be safely released into the atmosphere. The system (300) includes a feeding mechanism, and in particular an oxidant feeding mechanism, in the form of an injection member configured to feed or inject an oxidant into the cell (310). Suitably, the oxidant is fed into the sealed containment structure, and preferably the cell (310) to contact the biomass material (320) at multiple points in a sequence. The injection member may be duct, a conduit, a pipe, a tube, a channel, or the like. The injection member may be in the form of an injection duct and preferably a movable injection duct (330).

A plurality of oxidant outlets may be arranged at fixed locations on the movable injection duct (330). The, or each, oxidant outlet is arranged to carry a flow of an oxidant. The, or each, oxidant outlet may be oxidant injection nozzles (331, 332) may be arranged in fixed locations on the movable injection duct (330) to feed or inject the oxidant into a bed of the biomass material (320). The injection duct (330) may be positioned along a portion of the base of the cell (310), and may be aligned along an axis of the cell (310). Suitably, the oxidant is fed into the sealed cell (310) to contact the biomass material (320) at multiple points in a sequence.

In operation, when the biomass material (320) in the area, zone, vicinity of a first combustion zone (323) is nearly exhausted, the syngas quality shows early signs of deterioration, and/or after a specified duration, the movable injection duct (330) is retracted a distance substantially equal to a spacing between adjacent oxidant injection nozzles (331, 332), as shown in FIG. 7. After the retraction, a first nozzle (331) is moved to an existing injection/combustion zone (324) and a second nozzle (332) is moved to a location with unconverted biomass and without an existing combustion zone. In light of the selection of the spacing between the oxidant injection nozzles (331, 332), oxidant from the second nozzle (332) interacts with the established combustion zone (324), establishing a new combustion zone (325).

In alternative embodiments, it may be advantageous to establish one or more combustion zone(s) (323, 324, 325) using multiple oxidant injection nozzles (331, 332) of a specific size and spaced a specific distance apart on the movable injection duct (330). It is preferred that the, or each, combustion zone(s) (323, 324, 325) formed from adjacent oxidant injection nozzles (331, 332) can interact, and may even overlap. Suitably, if the distance between adjacent oxidant injection nozzles (331, 332) is too great then oxidant from the second nozzle (332) will be unable to establish a new combustion zone (325) and the oxidant could bypass the reaction zone leading to low gasification efficiency and high oxygen levels in the product gas. By way of example, using a 25 mm air injection duct and total air flows of about 100 litres per minute to 400 litres per minute at atmospheric pressure, the preferred spacing between oxidant injection nozzles (331, 332) was found to be between about 25 mm and about 100 mm, and more specifically about 50 mm. In alternative embodiments, the oxidant injection nozzles (331, 332) are positioned on the movable injection duct (330) so that the oxidant is directed horizontally into the bed, perpendicular to the axis of the injection duct (330). The present disclosure contemplates that in order to maintain high or improved gasification efficiency it is preferable that the biomass material (320) within the vicinity of the oxidant injection nozzles (331, 332) is partially or not completely consumed, thus establishing a profile (302), which moves through the bed with each retraction (303). Accordingly, the system (300) and a method thereof includes igniting at least a portion of the biomass material (320) loaded in the sealed containment structure in the form of the sealed cell (310) to form a thermally affected layer, and preferably a thermally affected biomass layer, wherein the step of feeding the oxidant into the sealed cell (310) is carried out so that conversion of the biomass material to a gas at one point in the sequence is initiated prior to complete conversion of the biomass material at a previous point in the sequence. Preferably, the biomass material (320) may be ignited near or at one end of the cell (310).

In an alternative embodiment, tar, water and other materials such as steam may be injected into combustion zones (323, 324, 325). In this way, the injection of a liquid tar-water mixture into the active gasification zone gasifies the tar and supplies water to the gasification reactions. Referring to FIG. 7, the movable injection duct (330) includes a tar-water injection line (326). The tar-water injection line (326) may include a tip that helps atomize the tar-water mixture when it enters into the stream of oxidant in the movable injection duct (330). Due to the potential very high temperatures (>1100° C.) in the associated combustion zone in the vicinity of the oxidant injection nozzles (331, 332), the tar will be combusted and/or cracked to smaller gaseous molecules and the water will be turned to steam, enhancing the char-steam gasification reaction and increasing the hydrogen content of the syngas.

Figure 8:
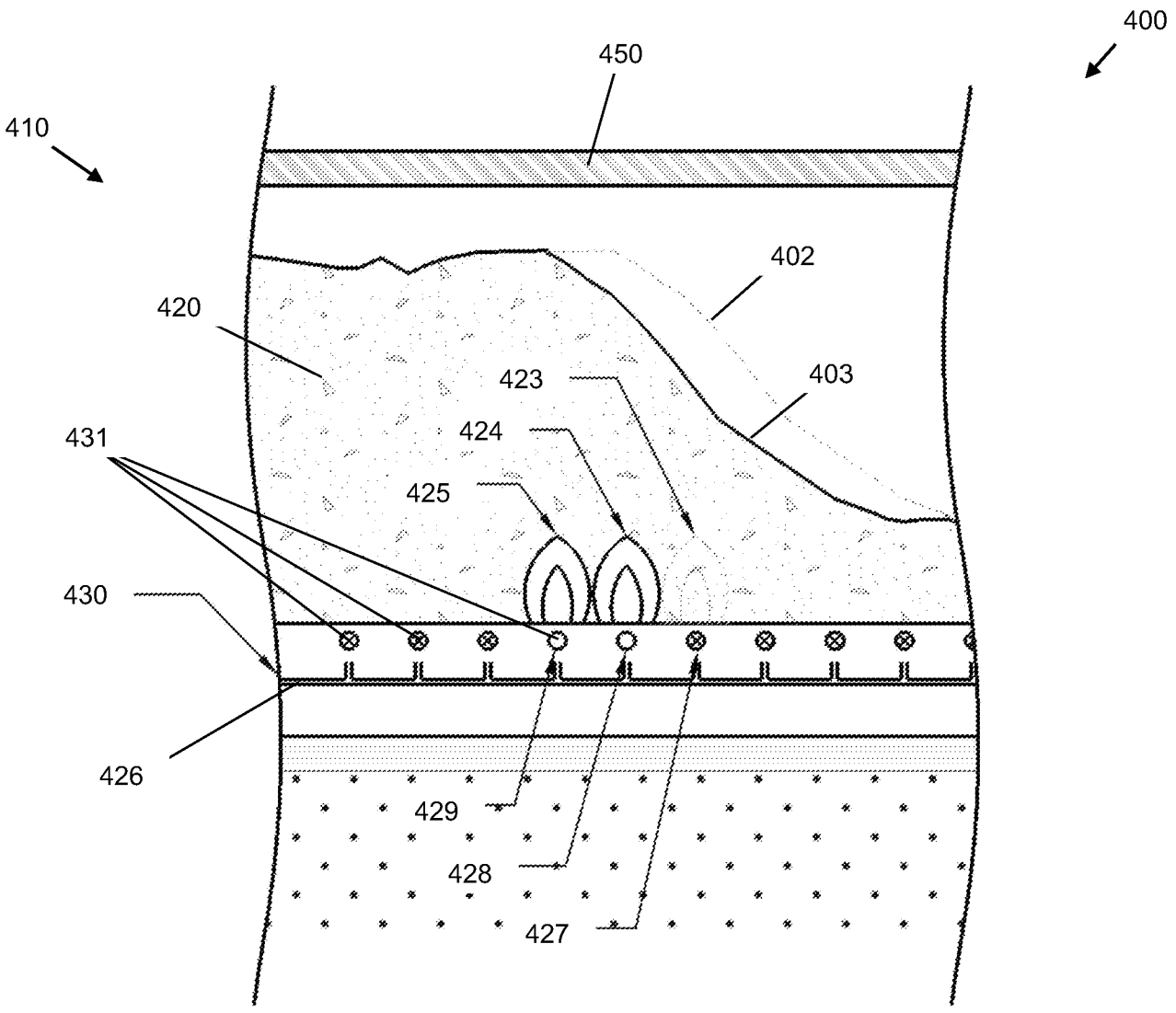
FIG. 8 is a cross-sectional side view of a method and a system according to yet a further exemplary embodiment of the present disclosure.

Reference is made to FIG. 8, which depicts a system (400) for performing a method of the present disclosure according to an exemplary embodiment. The system (400) includes a containment structure suitably configured to receive a combustible material. The containment structure may be in the form of a receptacle, a chamber, a cell, a pit, or a vessel. The system (400) includes a containment structure in the form of a cell (410) having a top cover (450) to substantially seal the cell (410). The cell (410) is rectangular in shape when viewed from above, although other shapes are contemplated by the present disclosure. The system (400) includes a feeding mechanism, and in particular an oxidant feeding mechanism, in the form of an injection member configured to feed or inject an oxidant into the cell (410). Suitably, the oxidant is fed into the sealed containment structure, and preferably the cell (410) to contact a combustible material in the form of a combustible material comprising a biomass material (420) at multiple points in a sequence. The injection member may be a duct, a conduit, a pipe, a tube, a channel, or the like. The injection member may be in the form of an injection duct and preferably a fixed injection duct (430).

A plurality of oxidant outlets arranged to carry a flow of an oxidant in the form of oxidant injection nozzles (427, 428, 429) are positioned at fixed locations on the fixed injection duct (430) and operated independently using one or more valves (431) to direct the oxidant into a biomass material (420). The injection duct (430) may be positioned along a portion of the base of the cell (410). The injection duct (430) may be aligned along an axis of the cell (410). The oxidant is fed into the sealed containment structure in the form of the sealed cell (410) to contact the biomass material (420) at multiple points in a sequence. The injection duct (430) may be configured to feed the oxidant in the sealed cell (410) to contact the biomass material (420) at multiple points in a sequence.

The biomass material (420) may include unprocessed, irregular and/or oversized material. It will be appreciated that the biomass material (420) may include other components such as water or small amounts of other particulate material. By opening the valves of some nozzles and closing the valves of others, the location of the combustion zone(s) (423, 424, 425) can be controlled and swept through the biomass material (420), and in particular a bed of the biomass material (420), in a manner similar to that of a movable injection duct as described herein. To move the location of a combustion zone (423), the new injection nozzle (429) is opened and the previous injection nozzle (427) is closed. During the procedure, the current injection nozzle (428) is kept open, so that there is continuity of the existing combustion zone (424). A new combustion zone (425) forms in the area of the new nozzle (429) due to burn back of the flame front from the existing combustion zone (424) and gasifies newly exposed biomass to produce syngas. The present disclosure contemplates that in order to maintain high or improved gasification efficiency it may be preferable that the biomass material (420) within the vicinity of the oxidant injection nozzles (427, 428, 429) is partially or not completely consumed, thus establishing a profile (402), which moves through the bed with each retraction (403). The method includes igniting at least a portion of the biomass material (420) loaded in the sealed cell (410) to form a thermally affected layer, and preferably a thermally affected biomass layer, wherein the step of feeding the oxidant into the sealed cell (410) is carried out so that conversion of the biomass material (420) to a gas at one point in the sequence is initiated prior to complete conversion of the biomass material at a previous point in the sequence. Preferably, the biomass material (420) is ignited near or at one end of the cell (410).

The fixed injection duct (430) may include a tar-water injection line (426), which may be individually connected to the oxidant injection nozzles (427, 428, 429) using valves. The tar-water injection line (426) may be fitted with a tip that helps atomize the tar-water mixture when it enters into the stream of oxidant leaving the nozzles. Due to the very high temperatures (>1100° C.) in the combustion zone (423, 424, 425) in the area, zone or vicinity of the nozzles (427, 428, 429), the tar will be combusted and/or cracked to smaller gaseous molecules and the water will be turned to steam, enhancing the char-steam gasification reaction and increasing the hydrogen content of the syngas. Accordingly, the injection of a liquid tar-water mixture into the active gasification zone gasifies the tar and supply water to the gasification reactions.

According to preferred embodiments, to facilitate gasification of the biomass material (320, 420), and in particular to consume a large fraction of the biomass material, the combustion zone (323, 324, 325 or 423, 424, 425) may be moved, transferred, transported, or swept through the bed, by sequential retraction of the movable injection duct (330), or alternatively sequential opening and closing of oxidant injection nozzles (427, 428, 429) on the fixed injection duct (430).

It may be desirable to maintain excess biomass material (carbonaceous material) in the area, zone or vicinity of the combustion zone(s) (323, 324, 325 or 423, 424, 425), so that substantially all of the oxidant injected into the biomass material from the oxidant injection nozzles (331, 332 or 427, 428, 429) is used to consume biomass close to the injection duct (330, 430). This establishes a very hot zone, above 1100° C., which is deficient of oxygen and has a high surface area of carbonaceous material. It has also been shown by the inventor/s that if the biomass material (320, 420) is exhausted within the vicinity of the oxidant injection nozzles (331, 332 or 427, 428, 429), if the rate of retraction or opening/closing of the oxidant injection nozzles (331, 332 or 427, 428, 429) respectively is too slow, then the oxidant can combust syngas and volatiles in the bed, which leads to a rapid deterioration in the quality of the syngas. Alternatively, it has been shown by the inventor/s that if the rate of retraction or opening/closing of the oxidant injection nozzles (331, 332 or 427, 428, 429) respectively is too fast, then there will be insufficient time for a new combustion zone (325, 425) to be established and consequently the combustion zone will not be moved, transferred, transported, or swept through the bed leading, thus potentially leading to poor or reduced performance and low conversion. Accordingly, there may be a preferred rate of retraction or opening/closing of the oxidant injection nozzles (331, 332 or 427, 428, 429) which sustains continuous production of syngas and ensures high or improved gasification efficiency, the desired syngas composition and a high or improved conversion of the biomass material (320, 420) into synthesis gas. The present disclosure contemplates that an average rate of retraction or opening/closing may be selected such that the overall conversion of the biomass feedstock per run is between about 30% and about 90%, and preferably between about 50 to about 80%. In alternative contemplated embodiments, an average rate of retraction or opening/closing may be selected such that the time between each retraction step or opening/closing is more than that required to establish a new combustion zone at the location of a new oxidant injection point. Alternatively, an average rate of retraction or opening/closing may be selected such that the time between each step is less than the time required to substantially convert all of the biomass feedstock above the combustion zone.

According to methods of the present disclosure, a portion or a fraction of the biomass material (3, 220, 320, 420) is converted to syngas, and a portion or a fraction is thermally affected without full conversion. The unconverted, thermally affected material forms a layer at the bottom of the cell (110, 210, 310, 410) near the injection duct (1, 230, 330, 430). Compared to a fresh or a further load, of combustible material (wherein preferably the combustible material is a biomass material) that has not been so treated, this layer has different characteristics including reduced moisture content, increased fixed carbon content, increased surface area, increased homogeneity and reduced average particle size (although without limitation thereto). During subsequent operations, the cell (110, 210, 310, 410) is refilled with fresh biomass which forms a layer on top of the thermally affected layer from the previous operation. Suitably, the containment structure is opened and loaded with a further biomass material. The further biomass material may crush and densify the thermally affected layer which has become brittle due to thermal exposure. During the gasification process, the thermally affected layer from the previous operation is partly or fully gasified, and the fresh biomass is heated and falls by gravity to form a new thermally affected layer at the bottom or base of the cell (110, 210, 310, 410) near the injection duct (1, 230, 330, 430). Relative to the further biomass material, the thermally affected layer preferably has one or more modified characteristics including, but not limited to, reduced moisture and volatiles content, increased surface area, reduced average particle size, reduced crushing strength and/or increased homogeneity. According to certain embodiments of the present disclosure, the combustion zones and gasification zones are connected via a permeable path to the production pipe (2, 240), so that the syngas can be readily extracted from the cell.

In an embodiment, a plurality of groupings of oxidant injection nozzles can be used to establish a plurality of combustion zones that are separated by a substantial distance which may be swept through the biomass material. The advantage of this configuration is that the syngas production capacity of each cell can be increased, with the consequence that the time taken for each run to convert the biomass feed is reduced. Preferably, the distance between multiple groupings of oxidant injection nozzles may be selected to be one to two orders of magnitude greater than the distance between adjacent oxidant injection nozzles.

Figure 9:
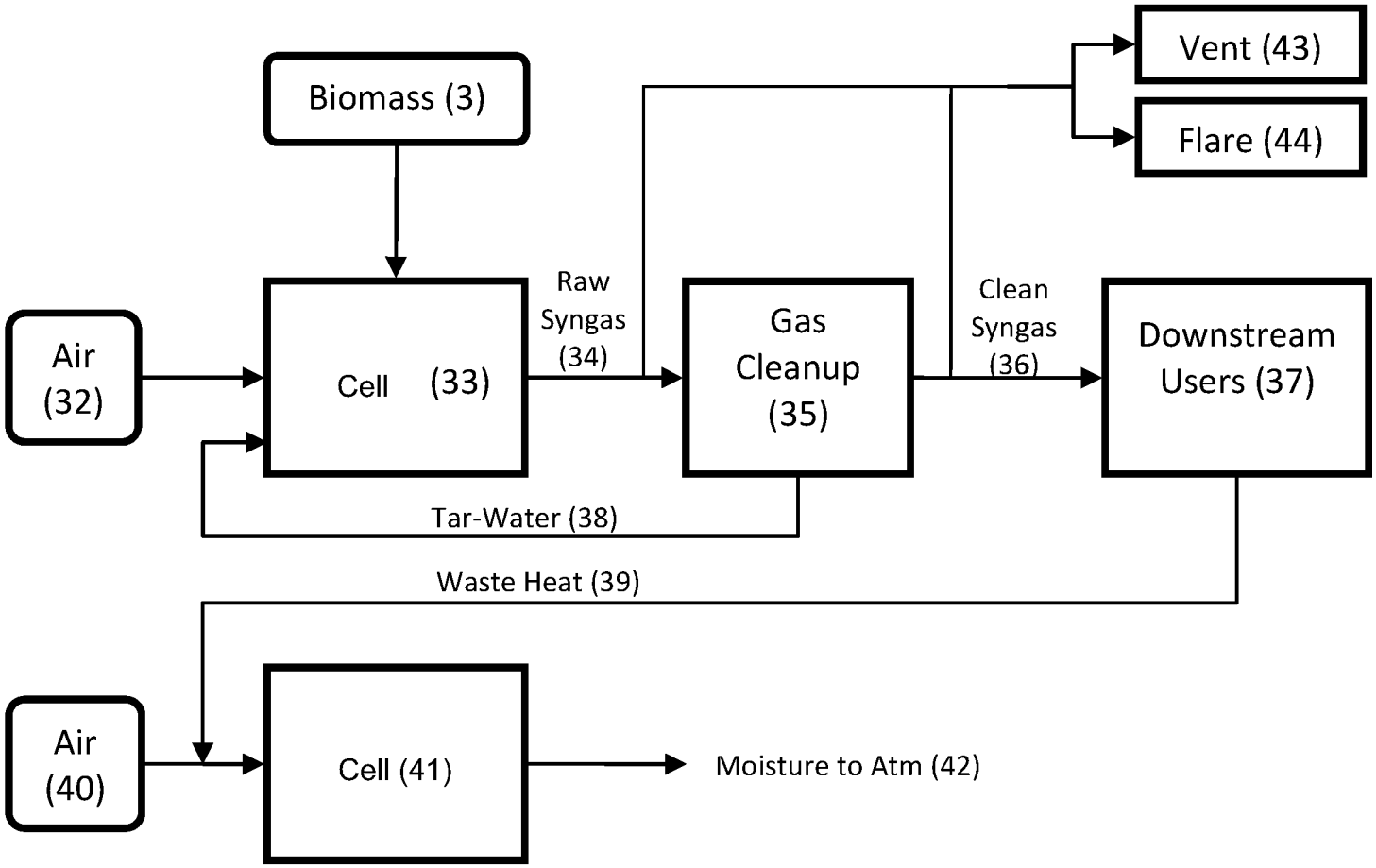
FIG. 9 is a flow chart of a method and a system including two (2) gasification systems according to a further exemplary embodiment of the present disclosure.

According to certain exemplary embodiments, multiple systems may be operably configured together to preferably facilitate a continuous and/or stable supply of syngas to downstream users. Referring to FIG. 9, two systems are shown. An oxidant that can be in the form of air (32) and a biomass material (3) may be supplied to a containment structure in the form of a cell (33), wherein the cell may be a reactor cell, which produces raw syngas (34). Raw syngas (34) may be cleaned in the gas clean up unit (35) to become clean syngas (36) which is converted to the final product, such as electricity in the downstream syngas user (37). Produced water and hydrocarbon by-products such as tar (38) may be separated from the syngas in the clean up unit and can be recycled to the cell (33). Waste heat (39) from the gas clean up unit (35) and/or the downstream syngas user (37) is used to heat a drying medium in the form of air (40). Air (40) may be injected into a cell (41) via a drying duct or the oxidant injection duct, and water evaporated (42) from the process is released to atmosphere. The degree of feedstock drying may be selected such that the remaining moisture in the feed can be recycled to the reactor via the tar-water line where it is converted into hydrogen, methane and water vapour. By recycling a suitable amount of water the process can operate with a high efficiency and dispose of wastewater. As herein described and according to the systems and methods of the present disclosure, the combustible material may be dried in situ after loading and prior to gasification. The degree of drying may be selected to remove sufficient moisture such that the excess moisture in the produced syngas can be recycled to the gasifier resulting in minimal or no wastewater requiring discharge. This obviates the need to pre-dry the biomass material prior to loading into the gasification apparatus.

The syngas is initially directed to a vent (43) during ignition due to the potential for oxygen in the gas and possibly explosive gas mixtures. Once positive ignition is confirmed and oxygen content in the product gas is below the safe limit the gas may be sent to a flare (44) and the oxidant injection rate may be increased to the normal design rate for gasification. Once the syngas quality is acceptable the syngas may be sent to the gas clean up unit (35) and end users (37).

According to the methods and systems of the present disclosure, preferably operating pressure and product gas pressure is near to atmospheric to avoid gas leakage and air ingress to the cell (110, 210, 310, 410). The product gas flow rate and composition may be controlled by varying the oxidant injection rate, composition and injection location. Typical commercial syngas production rates from a biomass gasifier can range from about 300 Nm3/h to about 5000 Nm3/h and the typical rate of biomass consumption can range from about 2 t/d to about 100 t/d.

In other embodiments, the hot product gas may be cooled and cleaned according to typical industry practice for biomass-derived syngas. Due to the long residence time and low velocities in the cell (110, 210, 310, 410), the production of heavy tar and particulates may be significantly lower than other biomass gasifiers. This may reduce the cost and complexity of gas clean up processes.

After the combustion zone has been swept through the entire length of the cell (110, 210, 310, 410), the injection of oxidant may be stopped. the cell (110, 210, 310, 410) is opened to enable materials to be removed or added to the cell (110, 210, 310, 410), the cell (110, 210, 310, 410) should be purged of volatile and harmful gases, and cooled to a temperature below the auto-ignition temperature of hot char/biomass and air. In certain embodiments, the methods of the present disclosure may include cooling the containment structure and its contents, and purging residual gases from the containment structure. At temperature, steam or inert gases such as nitrogen, argon or helium may be used to purge the cell (110, 210, 310, 410). In order, to limit the amount of steam and inert gas required for purging, in an embodiment it is preferred to apply a multi-step process to purge and cool the cell (110, 210, 310, 410). As described herein, the methods and systems of the present disclosure results in part of the biomass material being converted to syngas and part being thermally affected without full conversion. The unconverted, thermally affected material forms a layer at the bottom of the reactor near the injection duct. Furthermore, as described above, the oxidant is fed, displaced or moved, preferably by moving one or more oxidant outlets, such that the, or each, oxidant, and preferably an oxidant outlet, is moved or displaced in discrete intervals that maintain stable combustion zones while establishing new combustion zones. Suitably, moving or displacing the oxidant by moving the, or each, oxidant outlet prior to the overlying biomass being fully consumed may avoid breakthrough/bypassing of hot gases and oxidant to the top of the containment structure. It may be preferable to move or displace the, or each, oxidant outlet along an axis of the structure from one end to the other in order to sweep the gasification zone through the bed of biomass material.

Water and/or steam may initially be injected into the remaining bed of unconverted biomass feedstock and is used to both cool and purge the reactor simultaneously. Due to the nature of the process, only the bed materials in the vicinity of the combustion zone(s) are at a very high temperature at the end of each run. The temperature profile in the bed decreases towards the production pipe, which may have a temperature below 100° C. throughout most of the run.

To cool the combustion zone(s), water can be injected via the tar-water line (326, 426) and atomised by a small amount of nitrogen or other inert gas injected via the injection duct (330, 430). As the water droplets come into contact with the combustion zone they turn to steam, cooling the biomass feed and purging the reactor of volatile gases. The injection of water and inert gas can be continued until the temperatures in the bed are too low to enable effective generation of steam. At atmospheric pressure the bed can be cooled to a temperature of about 150° C. to 175° C. using water and inert gas injection. Once water injection has ceased, purging of the cell can continue with inert gas, such as nitrogen. The purging is continued until the temperature of the biomass material is sufficiently low that contact with air will not lead to the re-ignition of the biomass. The temperature of the biomass material is monitored using thermocouples to ensure that a sufficiently low and uniform temperature has been achieved.

To complete the cooling and purging of the cell, in the final stage air can be used, injected via the oxidant injection duct and/or the drying duct. The purging of the bed with air is continued until the concentration of volatiles, such as CO, in the off gas is below a safe level. The safe level will generally be set to limit the exposure of human operators to any harmful components in the syngas when the reactor cell is opened and being refilled with fresh biomass feedstock. In another embodiment, steam may be generated externally and injected via the injection duct and/or the drying duct to cool and purge the cell.

The volatile gases produced during the cooling and purging stages may be sent for use in the downstream process, or removed, if they are of sufficient quality or they may be disposed of in a flare or thermal oxidizer. In a configuration employing two or more cells, a newly filled and dried reactor cell will typically be ignited and started up to produce syngas before the currently operating cell is stopped and the cooling and purging stages are begun. Thus, the syngas and volatile gases produced during cooling and purging can be mixed with the syngas of the newly started up reactor and converted to products by the downstream users.

Once the injection point has been fully swept through the bed, injection of oxidant is stopped or ceased, and the containment structure is cooled and purged of residual gases. The top cover is then opened to permit refilling with biomass. Unconverted biomass and char may be simply left in the containment structure to be consumed in the next run, or may be removed. Ash falls to the bottom of the cell which requires periodic manual removal and disposal. Biomass material with high moisture content can be dried prior to gasification by injecting hot air (<100° C.) at the base of the bed which has been heated using waste heat from raw syngas cooling or from the gas engine. The process is suitably conducted in batches and may include a system in which at least two containments structures are employed to maintain continuous gas production, where one containment structure is in service while the other is being loaded or filled. The combination of containment structure width and height, and oxidant injection and retraction rates may be selected to avoid complete consumption of biomass at the containment structure walls, leaving a layer of biomass/char which provides thermal insulation for the process and prevents overheating of the containment structure walls. Suitably, the methods of the present disclosure may include controlling the flow of oxidant and/or controlling the rate of movement of the injection point(s) to achieve consistent production of high calorific value syngas, suitable for downstream applications such as electricity generation using gas engines. For such applications, typically the syngas calorific value may be maintained above a limiting value of between about 4.5 to 5.5 MJ/Nm3 and the total gas energy production rate (MWt) may be maintained within about +/−10% of the target value. Preferably, the methods of the present disclosure are able to achieve consistent gas production over long batch run times by preferably selecting a length of the containment structure to achieve the desired run time, while keeping a constant width of the containment structure.

Figure 10:
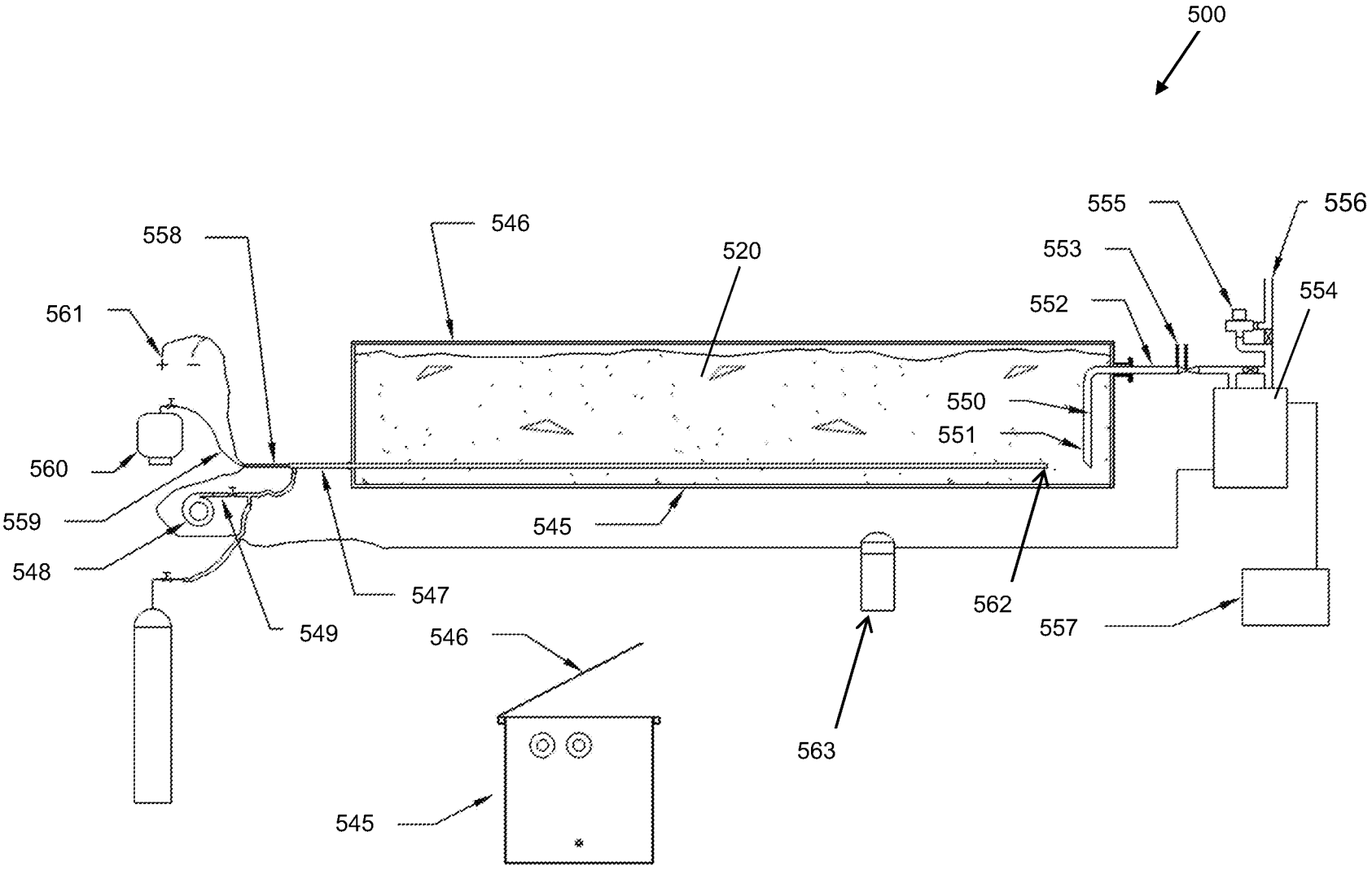
FIG. 10 is a cross-sectional side view of a method and a system according to an exemplary embodiment of the present disclosure.
Figure 11:
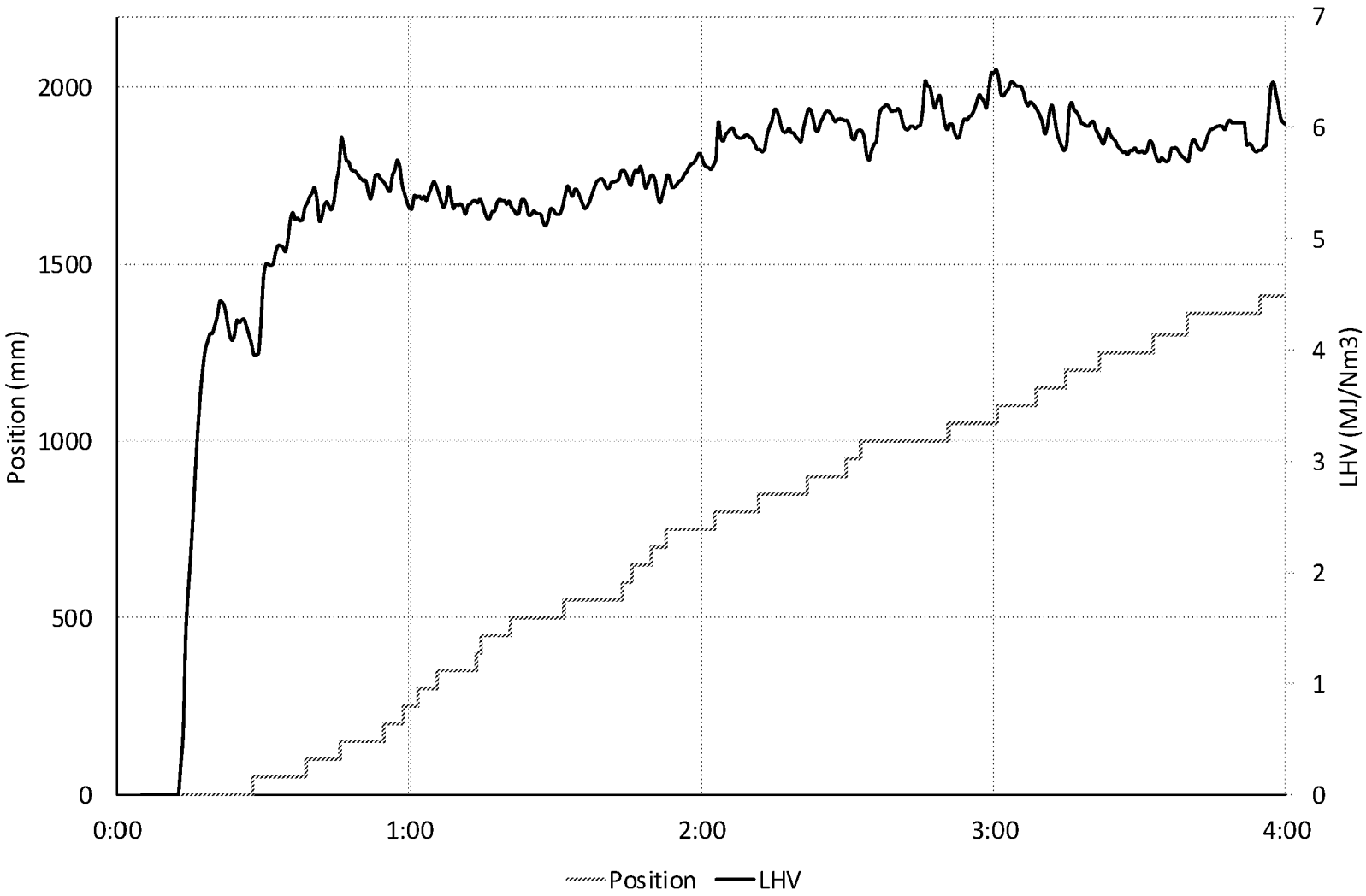
FIG. 11 is a graph showing gas quality trends using a method of producing a gas according to the system of FIG. 10.
Figure 12:
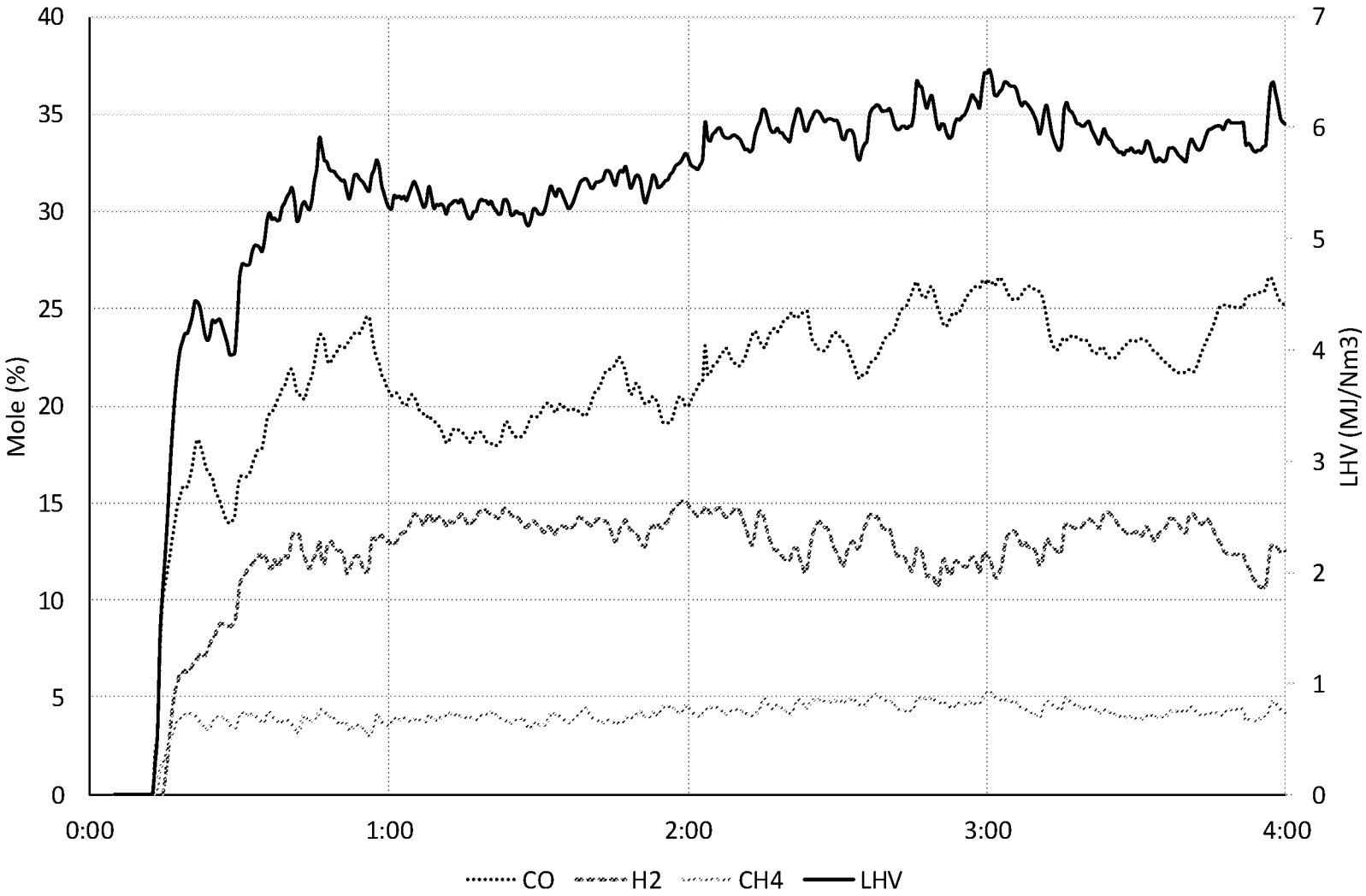
FIG. 12 is a graph showing gas quality trends using a method of producing a gas according to the system of FIG. 10.

Reference is now made to FIGS. 10 to 12, which demonstrates a non-limiting example of results from a pilot plant of a system (500) as shown in FIG. 10 according to an exemplary embodiment. The system (500) comprises a containment structure in the form of an open top carbon steel rectangular reactor cell (545) having preferable dimensions of about 900 mm wide, about 900 mm in height and with a length of about 4800 mm. The inside walls of the reactor cell (545) are lined with high temperature insulating fibre-board, and a top cover in the form of hinged steel lids (546) enable the reactor to be opened to load a biomass material (520), which can be in the form of a feedstock, and closed for operations. The reactor cell (545) was sealed using screw-fasteners and high temperature, teflon gasket tape. An injection duct (547) of diameter of about 1 inch is positioned near the bottom of the reactor cell (545) and air is supplied by an electric blower (548) and the air flow measured using a flowmeter (549).

Included is a production pipe (550) with a perforated inlet section (551) suitably located at the opposite end of the rectangular reactor vessel (545). The production pipe (550) exits from the reactor cell (545) and the temperature is measured using a thermocouple (552) and the syngas flow is measured using a venturi flowmeter (553). The product syngas enters a vessel which can be in the form a knock-out drum (554) where liquids are condensed. The syngas is then extracted from the knock-out drum (554) using a blower (555) and flows up the flare stack where it is combusted at the outlet (556). A small stream of syngas is passed through bubblers and a carbon bed before being routed to a portable analyser (557), which provides a periodic online measurement of the CO, $CO_2$, $H_2$, $CH_4$ and $O_2$ concentration in the syngas. Temperatures, flow rates and syngas composition were recorded using an online data collector and stored for analysis. The location of the injection duct (547) was recorded manually. A pump (563) is used to convey condensed liquids from the knock-out drum (554) to the injection point via tubing installed in the injection duct (547).

The reactor cell (545) was loaded with the biomass material (520) and the top of the reactor cell (545) sealed off by closing hinged steel lids (546). In the example presented herein, the biomass material (520) predominantly included Cyprus pine woodchips with an average size of about 50 mm.

The biomass near the end of the injection duct (547) is ignited using a retractable ignition tool (558). The ignition tool includes of a fuel delivery tube (559) of a diameter about 6 mm connected to a propane tank (560), an electrical glow plug connected to a power supply (561) and a thermocouple. The electrical glow plug is fixed to an end of the ignition tool (558), which is positioned inside the injection duct (547) near an injection point (562). Ignition is achieved by injecting a minimum air flow (circa <50 l/min) through the injection duct (547), turning on the glow plug and then feeding a very small supply of propane. Once ignition has been confirmed by the temperature reading, the ignition tool (558) can be removed from the injection duct (547) and the air flow steadily increased to the desired design capacity.

Gasification of wood chips was carried using the pilot plant (500). A movable oxidant injection duct with four air injection nozzles was installed into the reactor. The oxidant injection nozzles were placed at the end of the injection duct, with two on each side directed horizontally outwards into the bed. The oxidant injection nozzles had a diameter of 8 mm and were spaced 50 mm apart. FIG. 11 shows the lower heating value of the syngas (MJ/Nm3) and the position of the tip of the oxidant injection duct (547) (mm) as a function of time, over four hours of the example run. FIG. 12 shows the lower heating value of the syngas and the composition of the main combustible components of the syngas (mol %), namely CO, $H_2$ and $CH_4$, for the same run.

Referring to FIGS. 11 and 12, once ignition occurred at around time 10 minutes, the air flow was ramped up to the desired flow rate of 250 litre/minute over the subsequent period of 10 minutes and maintained at that level for the remainder of the run. During the period when the air injection was ramped up, the combustible components in the syngas began to increase due to the pyrolysis and gasification reactions and an increase in heating value was recorded. After the initial combustion zone location was established, the position of the oxidant injection duct was retracted by 50 mm for the first time at approximately 0.5 hrs. The oxidant injection duct was then retracted periodically, approximately 50 mm every 7 minutes or roughly at an equivalent continuous rate of 7 mm/min. As observed in FIG. 11, generally, when the position of the oxidant injection duct was retracted, the LHV of the syngas stayed stable or increased slightly. However, on occasions, retraction of the oxidant injection duct did not halt a small deterioration in the LHV of the syngas. On these occasions, it was shown that additional retraction of the injection duct would lead to a stable LHV value of the syngas and that the injection duct could be held at the new location for such time as to achieve the desired average retraction rate of approximately 7 mm/min.

It can be seen from FIG. 11 and FIG. 12 that while the position of the oxidant injection duct (547) has been moved 1410 mm through the bed of biomass feed, the lower heating value of the syngas and the composition of the syngas was successfully maintained at consistent values. In general, the LHV of the syngas was maintained at between 5.5 MJ/Nm3 and 6.5 MJ/Nm3, which is sufficient for use in reciprocating gas engines. While not shown, the flow rate of syngas produced was generally constant throughout the run. Following the run, the reactor was allowed to cool and was then purged prior to opening the lids. A layer of charred, thermally affected material remained in the reactor which occupied a volume of approximately 50% of the original biomass volume. The bulk density of the thermally affected material was found to be significantly lower than the fresh woodchips, indicating loss of moisture and volatiles. The reactor was then filled with fresh woodchips which formed a layer on top of the charred material.

Figure 13:
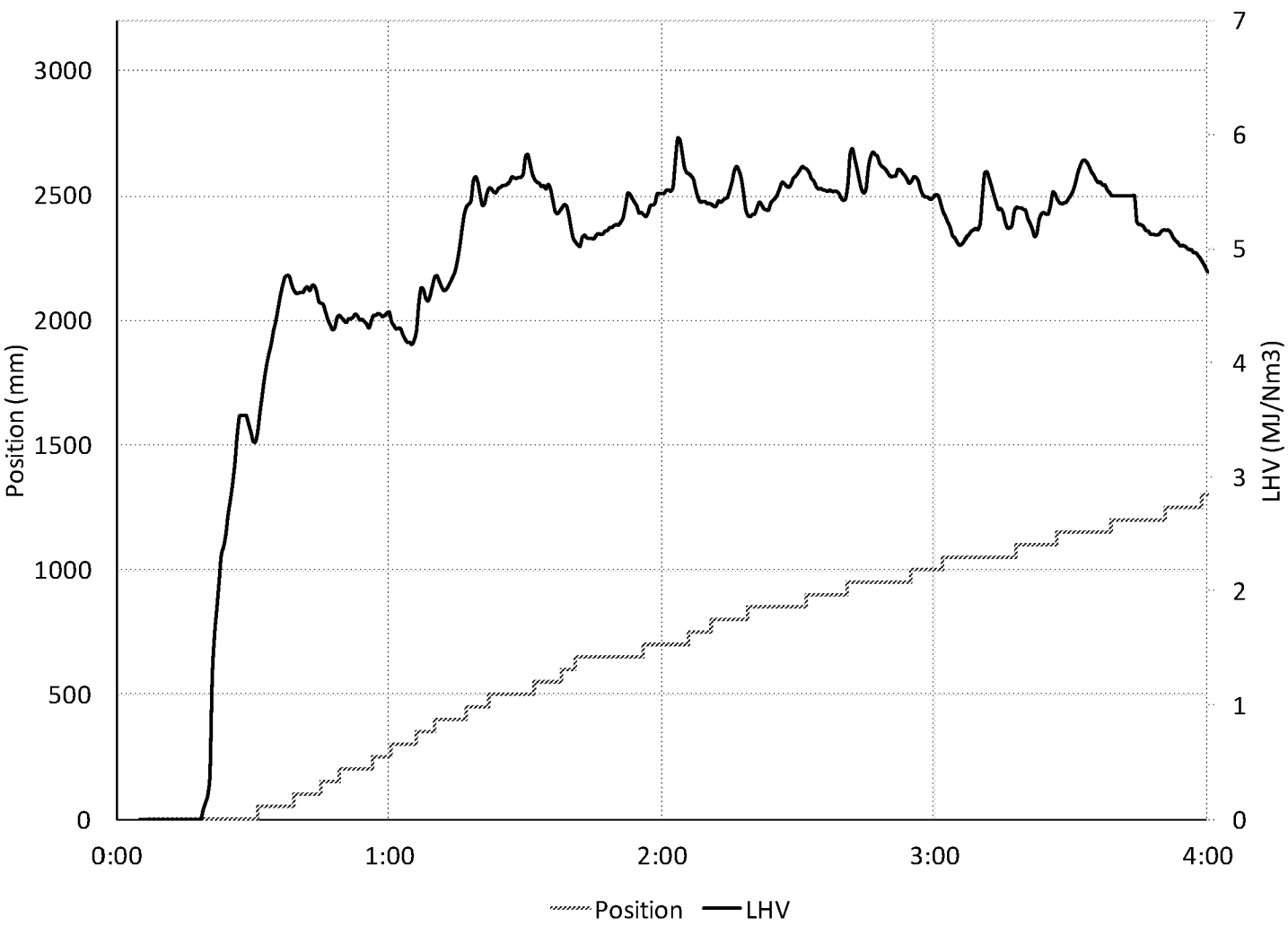
FIG. 13 is a graph showing gas quality trends using an exemplary embodiment of a method according to the present disclosure.
Figure 14:
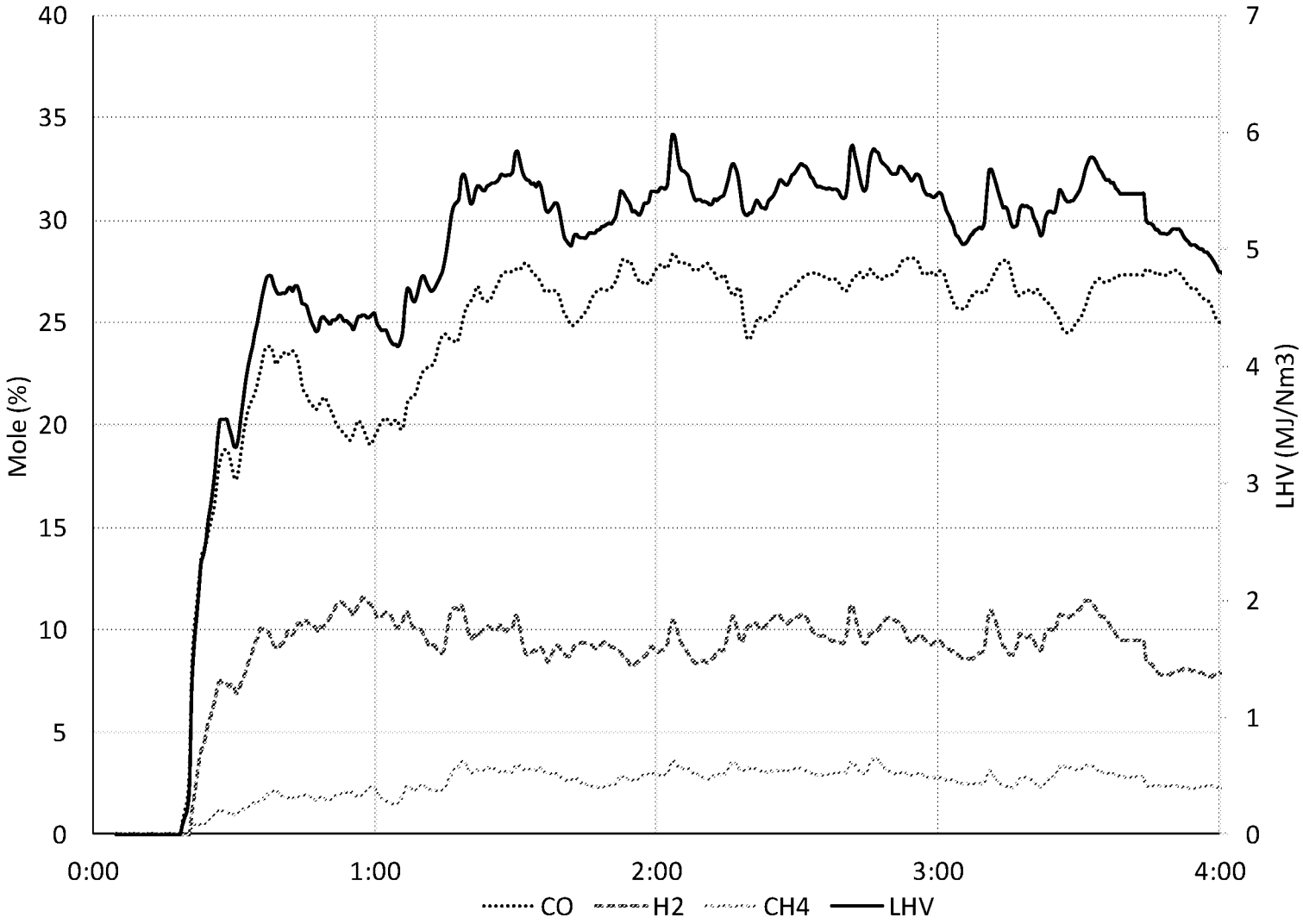
FIG. 14 is a graph showing gas quality trends using an exemplary embodiment of a method according to the present disclosure.

A new test run was subsequently performed using the same procedure as the previous run. It was shown that consistent gas quality could also be maintained by gasifying the bed of feedstock comprising of the distinct layers of thermally affected material on the bottom and fresh material on the top. Gas quality trends from this run are shown in FIG. 13 and FIG. 14. Post inspection of the reactor showed that a layer of thermally affected material remained in the reactor similar to the previous test.

The reactor was once again filled up with fresh woodchips and operated using the same procedure. Similar results were obtained as the previous run, indicating that the process is repeatable.

Figure 15:
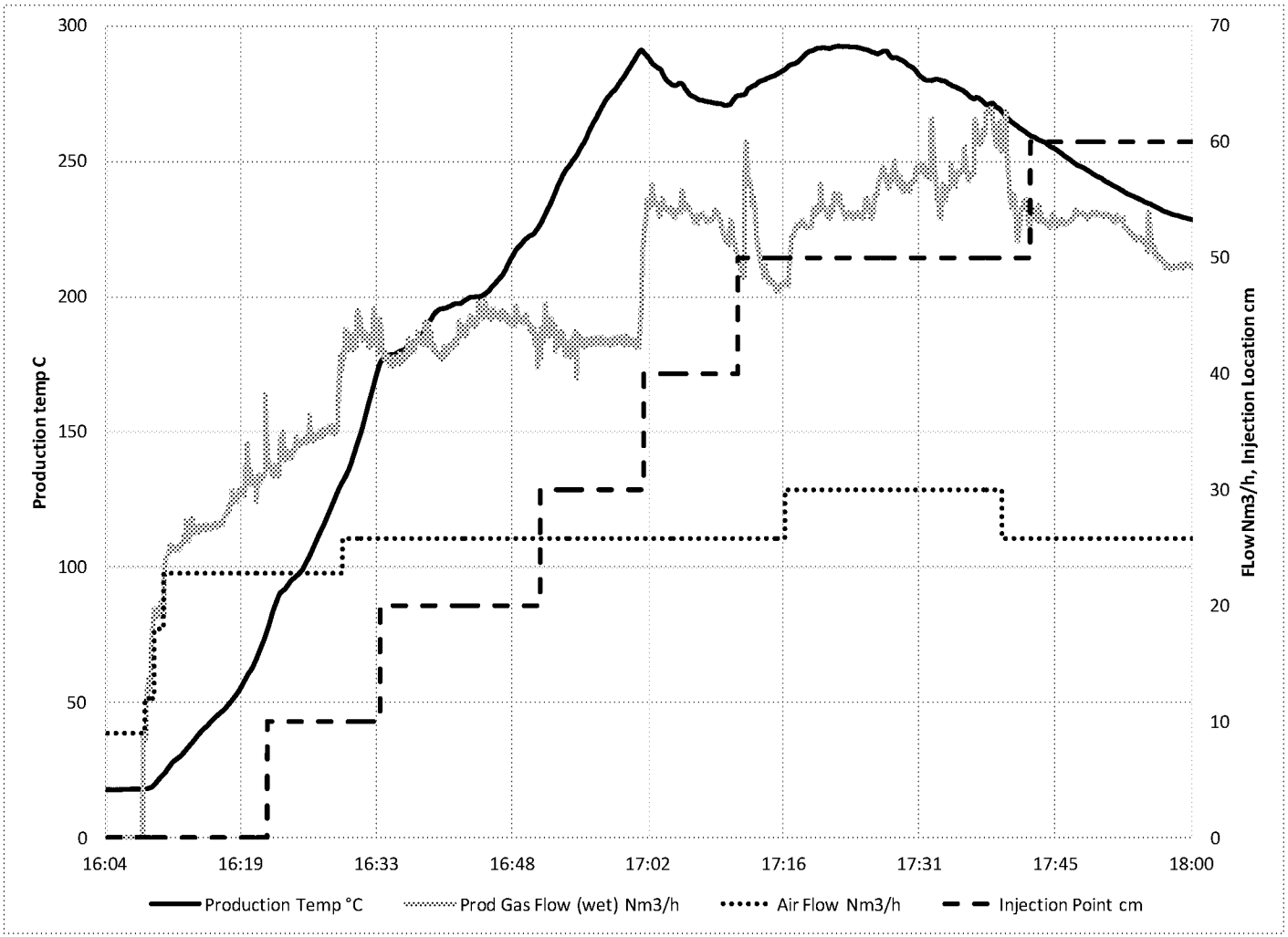
FIG. 15 is a graph showing gas quality trends using an exemplary embodiment of a method according to the present disclosure.
Figure 16:
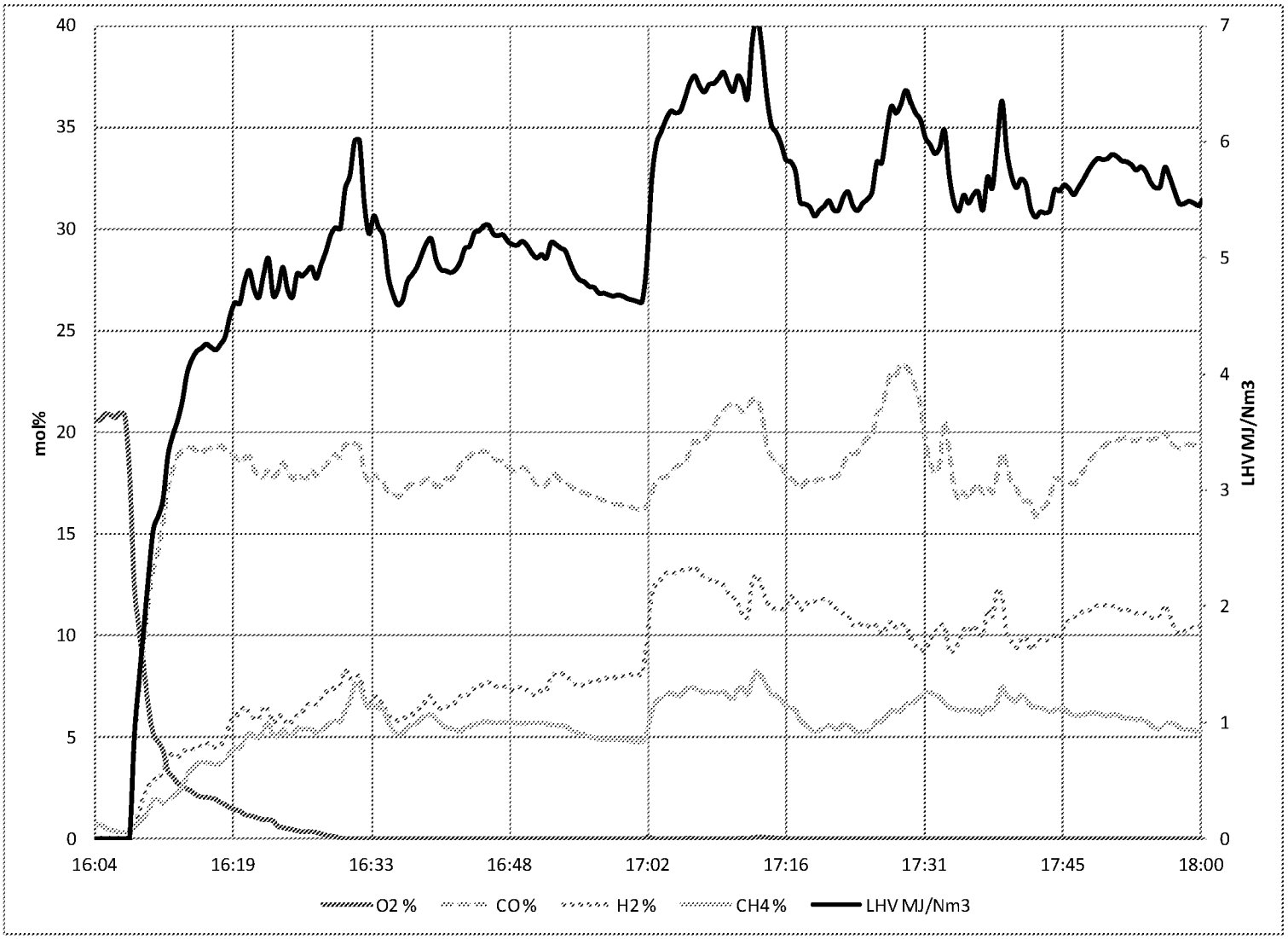
FIG. 16 is a graph showing gas quality trends using an exemplary embodiment of a method according to the present disclosure.

On another occasion the reactor was operated using shredded wood waste and a different style of injection tip was used which permitted moving the injection point larger distances at longer intervals. Gas quality trends and other data such as air and produced gas flow rate and produced gas temperature are shown in FIG. 15 and FIG. 16.

As shown herein, this example demonstrates the ability to gasify a combustible material in the form of a biomass material, in a batch process by sweeping a combustion zone and a gasification zone through a fixed bed of biomass material partly converting the biomass material and leaving the remainder as a thermally affected layer, and thus generating a stable quantity and quality of syngas for use in a downstream process. Accordingly, the present disclosure contemplates methods and systems to gasify a combustible material in a batch process which includes sweeping a combustion zone and a gasification zone through a bed of combustible material, and in particular a fixed bed of combustible material, thereby partly converting the combustible material and leaving the remainder as a thermally affected layer, and thus generating a stable quantity and quality of syngas for use in a downstream process.

One or more advantages of the present disclosure described herein include, but are not limited, to: (i) application of the moving injection concept within a man-made gas-tight containment structure to gasify a combustible material, such as a biomass material, by a batch method; (ii) applying this method to a biomass material enables the use of unprocessed, irregular and/or oversize biomass material that are not conducive to use in a continuously fed gasification system; (iii) the methods and systems of the process can accommodate a large batch size while still producing stable, and an improved syngas or a high quality syngas over long periods, particularly relative to other batch type gasifiers/incinerators (iv) moving an injection point prior to the overlying combustible material, (preferably biomass material) being fully consumed avoids breakthrough/bypassing of hot gases and oxidant to the top of the containment structure; (v) reduced capital cost due, at least in part, to simple construction methods, elimination of feedstock storage and processing, and very high feedstock flexibility; (vi) reduced or lower tar, and particulate content in the syngas due to increased residence time and low velocities in the gasifier; (vii) a batch process with no continuous feeding of the combustible material; (viii) thermal decomposition of tars is promoted due, at least in part, to volume of combustible (such as biomass) material and greater separation of the injection and production points; and/or (ix) repeated cycles of the methods of the present disclosure may have the effect that during each subsequent operation, the oxidant injection points are swept through the thermally affected layer from the previous operation, gaining the benefit of thermal pretreatment of the fresh biomass feed and improving the consistency of the process, particularly if the fresh feed contains large, oversize material.

The disclosure of every patent, patent application, and publication cited herein is hereby incorporated herein by reference in its entirety.

Throughout the specification, including the claims, where the context permits, the term "comprising" and variants thereof such as "comprise" or "comprises" are to be interpreted as including the stated integer or integers without necessarily excluding any other integers.

By "about" is meant a quantity, level, value, number, frequency, percentage, dimension, size, amount, weight or length that varies by as much 15, 14, 13, 12, 11, 10, 9, 8, 7, 6, 5, 4, 3, 2 or 1% to a reference quantity, level, value, number, frequency, percentage, dimension, size, amount, weight or length.

The citation of any reference herein should not be construed as an admission that such reference is available as "Prior Art" to the instant application.

The features described with respect to one embodiment may be applied to other embodiments, or combined with or interchanged with the features of other embodiments, as appropriate, without departing from the scope of the present disclosure.

Throughout the specification the aim has been to describe the preferred embodiments of the present disclosure without limiting the present disclosure to any one embodiment or specific collection of features. Those of skill in the art will therefore appreciate that, in light of the instant disclosure, various modifications and changes can be made in the particular embodiments exemplified without departing from the scope of the present disclosure. All such modifications and changes are intended to be included within the scope of the appended claims.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

The invention claimed is:

1. A method of producing a gas from a combustible material, the method comprising the steps of:

(a) loading the combustible material into a containment structure which is longer along a horizontal axis compared to a width or a height to form a bed;

(b) substantially sealing the containment structure;

(c) feeding an oxidant into the sealed containment structure and igniting the combustible material to form a gasification zone;

(d) moving an oxidant injection point from one end to the other end along a horizontal axis at the base of the structure;

(e) controlling a flow rate of oxidant and a rate of movement of the oxidant injection point such that the combustible material is partly converted, thereby leaving behind an unconverted, thermally affected layer of combustible material in the sealed containment structure after the injection point has passed through the material;

f) cooling and purging the sealed containment structure and loading fresh combustible material on top of the thermally affected layer left behind after completing steps c) to e); and g) repeating steps b) to f), wherein the oxidant is fed into the sealed containment structure by an injection member; and wherein the injection member is configured to be movable in the containment structure such that an oxidant outlet at a previous point in the sequence is moved to a new point in the sequence for initiation of gas conversion, and is replaced at the previous point by a further oxidant outlet that at least partially continues conversion of the combustible material at the previous point.

2. The method of claim 1, wherein the injection member is positioned along at least a portion of a base of the containment structure.

3. The method of claim 1, wherein the distance moved is substantially equal to a spacing between adjacent oxidant outlets.

4. The method of claim 1, wherein the injection member is a duct configured to be retractable along a length of the containment structure.

5. The method of claim 4, wherein the plurality of oxidant outlets are at fixed positions on the duct.

6. A method of producing a gas from a combustible material, the method comprising the steps of:

(a) loading the combustible material into a containment structure which is longer along a horizontal axis compared to a width or a height to form a bed;

(b) substantially sealing the containment structure;

(c) feeding an oxidant into the sealed containment structure and igniting the combustible material to form a gasification zone;

(d) moving an oxidant injection point from one end to the other end along a horizontal axis at the base of the structure;

(e) controlling a flow rate of oxidant and a rate of movement of the oxidant injection point such that the combustible material is partly converted, thereby leaving behind an unconverted, thermally affected layer of combustible material in the sealed containment structure after the injection point has passed through the material;

f) cooling and purging the sealed containment structure and loading fresh combustible material on top of the thermally affected layer left behind after completing steps c) to e); and g) repeating steps b) to f), wherein the oxidant is fed into the sealed containment structure by an injection member configured to include a plurality of oxidant outlets arranged in sequence to carry a flow of an oxidant;

wherein the plurality of oxidant outlets are arranged along an injection member configured to be fixed in the containment structure along an axis, and wherein the, or each, oxidant outlet includes a valve to operably regulate the flow of the oxidant from the, or each, oxidant outlet such that during operation, an oxidant outlet at a previous point in the sequence is substantially closed and a further oxidant outlet at a new point in the sequence for initiation of gas conversion is substantially opened in such a way as to emulate a movable injection member.

7. The method of claim 6, wherein an oxidant outlet interposing the previous point and the new point is kept substantially opened to thereby maintain conversion at that point.

8. The method of claim 6, wherein the, or each, oxidant outlets are of generally equal size.

* * * * *